US011993425B2

(12) United States Patent
Van Dord

(10) Patent No.: US 11,993,425 B2
(45) Date of Patent: May 28, 2024

(54) CAP FOR DISPENSING LIQUIDS FROM A CONTAINER

(71) Applicant: CAPS & CLOSURES PTY. LTD, Dandenong South (AU)

(72) Inventor: Michael Richard Van Dord, Narre Warren (AU)

(73) Assignee: CAPS & CLOSURES PTY. LTD, Dandenong South (AU)

( * ) Notice: Subject to any disclaimer, the term of this patent is extended or adjusted under 35 U.S.C. 154(b) by 424 days.

(21) Appl. No.: 17/413,720

(22) PCT Filed: Dec. 12, 2018

(86) PCT No.: PCT/AU2018/051329
§ 371 (c)(1),
(2) Date: Jun. 14, 2021

(87) PCT Pub. No.: WO2020/118344
PCT Pub. Date: Jun. 18, 2020

(65) Prior Publication Data

US 2022/0017271 A1 Jan. 20, 2022

(51) Int. Cl.
*B65D 47/04* (2006.01)
*B65D 47/32* (2006.01)
(Continued)

(52) U.S. Cl.
CPC ..... *B65D 47/043* (2013.01); *B65D 47/32* (2013.01); *B65D 50/041* (2013.01);
(Continued)

(58) Field of Classification Search
CPC .... B65D 47/043; B65D 47/32; B65D 50/041; B65D 51/1611; B65D 51/18;
(Continued)

(56) References Cited

U.S. PATENT DOCUMENTS 4,261,487 A 4/1981 Seager
6,213,351 B1 4/2001 Stoneberg et al.
(Continued)

FOREIGN PATENT DOCUMENTS

AT 12359 * 4/2012
CH 691587 A5 8/2001
(Continued)

OTHER PUBLICATIONS

Mar. 6, 2019 International Search Report issued in International Patent Application No. PCT/AU2018/051329.
(Continued)

*Primary Examiner* — Bob Zadeh
(74) *Attorney, Agent, or Firm* — Williams Mullen; R. Brian Drozd

(57) ABSTRACT

A cap for a container including a dispensing opening operable to be selectively sealed and a housing configured for sealing engagement with a container opening, said housing defining a passage along a longitudinal axis thereof, the passage having a plurality of ribs disposed in the passage defining a plurality of channels which, when the container is in a sufficiently tilted state, cause liquid in the container to exit through the dispensing opening, wherein at least one channel is a liquid-flow channel through which liquid flows out of the dispensing opening when unsealed.

13 Claims, 33 Drawing Sheets

(51) Int. Cl.
*B65D 50/04* (2006.01)
*B65D 51/16* (2006.01)
*B65D 51/18* (2006.01)

(52) U.S. Cl.
CPC ..... *B65D 51/1611* (2013.01); *B65D 51/18* (2013.01); *B65D 2215/02* (2013.01); *B65D 2251/0025* (2013.01); *B65D 2251/009* (2013.01)

(58) Field of Classification Search
CPC ..... B65D 2215/02; B65D 2251/0025; B65D 2251/009; B65D 47/24
See application file for complete search history.

(56) References Cited

U.S. PATENT DOCUMENTS

| | | | | |
|---|---|---|---|---|
| 6,758,376 | B1 * | 7/2004 | Clodfelter | B65D 41/045 222/549 |
| 6,938,794 | B2 * | 9/2005 | Elder | B65D 5/747 220/717 |
| 7,014,075 | B2 | 3/2006 | Bonifacio et al. | |
| 2004/0026465 | A1 | 2/2004 | Klopfer | |
| 2004/0050884 | A1 | 3/2004 | Boggs et al. | |
| 2008/0277371 | A1 * | 11/2008 | Weist | B65D 55/024 215/277 |
| 2017/0233148 | A1 | 8/2017 | Meyer | |
| 2017/0267425 | A1 | 9/2017 | Stratton | |

FOREIGN PATENT DOCUMENTS

| | | | |
|---|---|---|---|
| CN | 1484601 | * | 3/2004 |
| EP | 2915585 | A1 | 9/2015 |
| EP | 3 345 514 | A1 | 7/2018 |
| EP | 3 398 873 | A1 | 11/2018 |
| ES | 1215591 | U | 7/2018 |
| KR | 100860834 | * | 9/2008 |
| WO | 2014/100345 | A1 | 6/2014 |

OTHER PUBLICATIONS

Mar. 6, 2019 Written Opinion issued in International patent Application No. PCT/AU2018/051329.
Dec. 9, 2020 International Preliminary Report on Patentability issued in International Patent Application No. PCT/AU2018/051329.
Jul. 27, 2018 International-Type Search Report Issued in Australian Provisional Patent Application No. 2017903765.
Jun. 29, 2022 Extended Search Report issued in European Patent Application No. 18942732.1.
Sep. 20, 2023 Office Action issued in European Patent Application No. 18942732.1.

* cited by examiner

CAP FOR DISPENSING LIQUIDS FROM A CONTAINER

FIELD OF THE INVENTION

The present invention relates to the field of caps and/or closures for bottles, containers and the like. In particular, the present invention relates to methods of manufacturing such caps and/or closures and the products produced by such methods.

BACKGROUND OF THE INVENTION

There are a myriad of caps and/or closures of different shapes and sealing mechanisms used with bottles for containing a variety of fluids including, but not limited to, industrial chemicals, chemical reagents and cleaning liquids. Such fluids tend to be either highly corrosive or acidic and hence, can cause injury to persons dispensing same from a bottle, in particular, if the fluid comes into contact with the individual's eyes and/or skin during dispensing.

Conventional caps and closures for bottles generally include a thread located on the internal side surface of the cap that engages a corresponding thread located on the external surface of the bottle neck to thereby enable the cap/closure to be fixed to the bottle neck by a twisting/rotating motion of the cap in one direction relative to the bottle, to thereby seal or "close" the bottle. In order to disengage the cap/closure from the bottle and thereby "open" the bottle, the cap/closure is rotated/twisted in the opposite direction.

Conventional cap/closure systems for bottles may also include a separate sealing component that is usually in the form of a disc fabricated from plastic or any type of impervious material that is heat sealed, or otherwise fixed, to the bottle opening to thereby seal the opening and avoid the risk of spillage/leaking of any fluid, particularly during packing and transport of the bottles at which times the bottles are often tilted from the upright position.

However, conventional caps and closures have associated problems, since such caps/closures must be fully detached during opening of the bottle and dispensing of fluid, which can lead to loss of the cap. This is problematic in instances in which only a portion of the fluid is dispensed at any given time, and under such circumstances, bottles are either maintained in an open state or some other type ad hoc sealing mechanism must be adopted to close the bottle. Clearly this is undesirable since this increases the risk of spillage/leakage, which is even more problematic in the instance of hazardous fluids and thereby presents an occupational health and safety issue.

The use of a separate seal in conjunction with a cap/closure in order to prevent leakage of fluid during packing and transport is also problematic since such seals are for one-time use only, and therefore, the risk of leakage after the bottle is initially opened is increased in instances where only a portion of the container contents is dispensed at any given time.

The dispensing of hazardous (corrosive) fluids is also problematic during instances in which large volumes of fluid are dispensed and/or in instances in which a volume of fluid has to be rapidly dispensed. This typically results in a non-uniform "glugging" action accompanied by splashing of the liquid during dispensing which is, for reasons previously discussed, an occupational health and safety issue. It is understood that the "glugging" action arises as a result of the creation of a pressure differential between the interior and exterior of the bottle as the bottle contents are dispensed. When the external pressure increases to a point above the internal pressure of the bottle, the external pressure forces air back into the bottle in an attempt to equalize the internal and external pressure, thereby simultaneously forcing fluid to rapidly flow out of the bottle. This action causes the formation of a pocket of air which results in the familiar "glug".

In order to avoid "glugging" and the any resulting splashing of the bottle contents during dispensing, the usual practice is to puncture the bottle so as to form an aperture through which air can enter thereby maintaining an equalized pressure between the internal and exterior of the bottle and thereby facilitate uninform fluid flow in the absence of "glugging".

However, it will be appreciated that puncturing the bottle is undesirable from an occupational health and safety perspective since the aperture can lead to leakage/spillage of the vessel contents, and also, present a problem in the event only a portion of the vessel contents are dispensed at any given time.

Accordingly, there exists the need for a cap and/or closure for bottles, containers and the like that ameliorates, or at least provides an alternative to, conventional caps and closures and methods of dispensing fluids from bottles and containers sealed by same.

SUMMARY OF THE INVENTION

In one aspect, the present invention provides a cap for a container including a dispensing opening operable to be selectively sealed and a housing configured for sealing engagement with a container opening, said housing defining a passage along a longitudinal axis thereof, the passage having one or more ribs disposed in the passage defining a plurality of channels which, when the container is in a sufficiently tilted state, cause liquid in the container to exit through the dispensing opening, wherein at least one channel is a liquid-flow channel through which liquid flows out of the container dispensing opening when unsealed.

In an embodiment, the ribs are defined in a spoke arrangement. However, other rib configurations are possible. For example, the ribs may be one or more tubes defined within the passage extending along the longitudinal axis thereof, or may be a series of straight intersecting walls defining a plurality of flow passages. In another embodiment, the ribs may be a series of concentric circles located within the passage.

In an embodiment, the passage extends substantially into the container when the cap housing is in sealing engagement with the container opening. In this embodiment, since the passage extends substantially into the container when the cap housing is in sealing engagement with the container, it will be understood the plurality of channels do not project substantially beyond the outer perimeter of the container, thereby allowing/enabling stacking of the containers.

It will also be understood that any number of ribs may be adopted to thereby define any number of channels through which fluid may flow. In an embodiment, the ribs define at least 4 channels. In an embodiment, the ribs define between 4 and 10 channels. In an embodiment, the ribs define 8 channels. In an embodiment, the housing includes an inner member and an outer member, said inner member configured to engage the container opening and the outer member configured to engage the inner member.

In an embodiment, the inner member and the outer member are engaged by a threaded connection.

In an embodiment, the outer member is moveable between a first position in which the outer member is tightened on the inner member and a first seal is operable between the outer member and inner member to prevent the flow of liquid out from the dispensing opening, and a second position in which the outer member is loosened from the inner member and wherein the first seal is inoperable such that liquid is not prevented from flowing out from the dispensing opening.

In an embodiment, the flow rate of liquid through the dispensing opening is based upon an extent to which the outer member is loosened from the inner member.

In an embodiment, the housing is configured to prevent the outer member from being removed from the inner member. Accordingly, the inner and outer members remain engaged during operation (pouring) of the liquid contents.

In an embodiment, disengagement of the outer member from the inner member is prevented by the use of one or more flexible tongues that limits the rotation of the outer member relative to the inner member.

In an embodiment, the outer member has associated therewith the one or more ribs, the one or more ribs extending radially from an outer portion of the outer member towards a central support structure that extends substantially along said longitudinal axis, said central support structure including a base portion that extends radially outwardly a sufficient distance such that an outer periphery of the support structure base portion is disposed in a path of liquid and/or air flow through the plurality of channels and forms part of said first seal.

In an embodiment, the inner member includes an internal annulus that at least partially defines said passage, the internal annulus including a base portion that extends radially inwardly a sufficient distance such that an inner periphery of the internal annulus base portion forms part of said first seal and is caused to abut with the outer periphery of the support structure base portion when the outer member is in said first position.

In an embodiment, the housing further includes a second seal defined between the inner member and the outer member of the housing to thereby substantially prevent the flow of liquid between the inner and outer member.

In an embodiment, the housing further includes a third seal defined between the inner member and the container opening to thereby substantially prevent the flow of liquid between the container opening and the inner member.

In an embodiment, the inner member includes one or more guide lugs configured to engage one or more corresponding drive lugs located on the outer member, wherein the drive lugs located on the outer member enable the inner member to be threadedly connected to a container neck portion by rotating the outer member relative to the container.

In an embodiment, the outer member includes one or more apertures that serve as vent holes.

In an embodiment, the inner member includes an internal ratchet located on a rim (i.e., sidewall) wherein the teeth of the internal ratchet engage at least a portion of the container opening (neck portion) to thereby restrict rotation of the inner member to one direction only such that threaded connection of the inner member to the container is enabled whilst preventing disengagement of the inner member from the container.

In an embodiment, the inner member includes an external ratchet located on the rim wherein the teeth of the external ratchet engage at least a portion of a ring connected to the periphery of the outer member by a plurality of bridges that are capable of being broken upon the application of a force, wherein movement of the outer member relative to the inner member is prevented whilst the bridges are intact, and wherein movement of the outer member relative to inner member is enabled once the bridges are broken to thereby enable the outer member to be moved from the first position to the second position.

In another aspect, the present invention provides a method of dispensing liquid from a container, the method including tilting the container to cause liquid in the container to exit through a dispensing opening of a cap operable for sealing engagement with an opening of the container, the cap including, a dispensing opening operable to be selectively sealed, and a housing configured for sealing engagement with the container opening, said housing defining a passage along a longitudinal axis thereof, the passage having a plurality of ribs disposed in the passage defining a plurality of channels which, when the container is in a sufficiently tilted state, cause liquid in the container to exit through the dispensing opening, wherein at least one channel is a liquid-flow channel through which liquid flows out of the dispensing opening when unsealed.

In another aspect, the present invention provides a container assembly including a container and a cap, the cap including a dispensing opening operable to be selectively sealed and a housing configured for sealing engagement with an opening in the container, said housing defining a passage along a longitudinal axis thereof, the passage having a plurality of ribs disposed in the passage defining a plurality of channels which, when the container is in a sufficiently tilted state, cause liquid in the container to exit through the dispensing opening, wherein at least one channel is a liquid-flow channel through which liquid flows out of the dispensing opening when unsealed.

In another aspect, the present invention provides a method of manufacturing a cap for sealing engagement with a container opening, the method including the steps of: additively fabricating a housing defining a passage along a longitudinal axis thereof, the housing including: an external wall enclosing an internal spoke arrangement of a plurality of ribs radially emanating from a central support structure thereby defining a plurality of channels, wherein the external wall, spoke arrangement and central support structure together define an outer member of the cap, and an inner member of the cap, wherein the inner member is configured to sealingly engage the container opening by threaded connection and is also configured to sealingly engage the outer member by threaded connection.

BRIEF DESCRIPTION OF THE DRAWINGS

Embodiments of the invention will now be described in further detail with reference to the accompanying figures in which.

DETAILED DESCRIPTION OF THE EMBODIMENT(S) OF THE INVENTION

For convenience, the invention will be described with respect to one or more particular embodiments, however it will be appreciated by those skilled in the art that the invention is not limited to these one or more particular embodiments.

Figure 1:
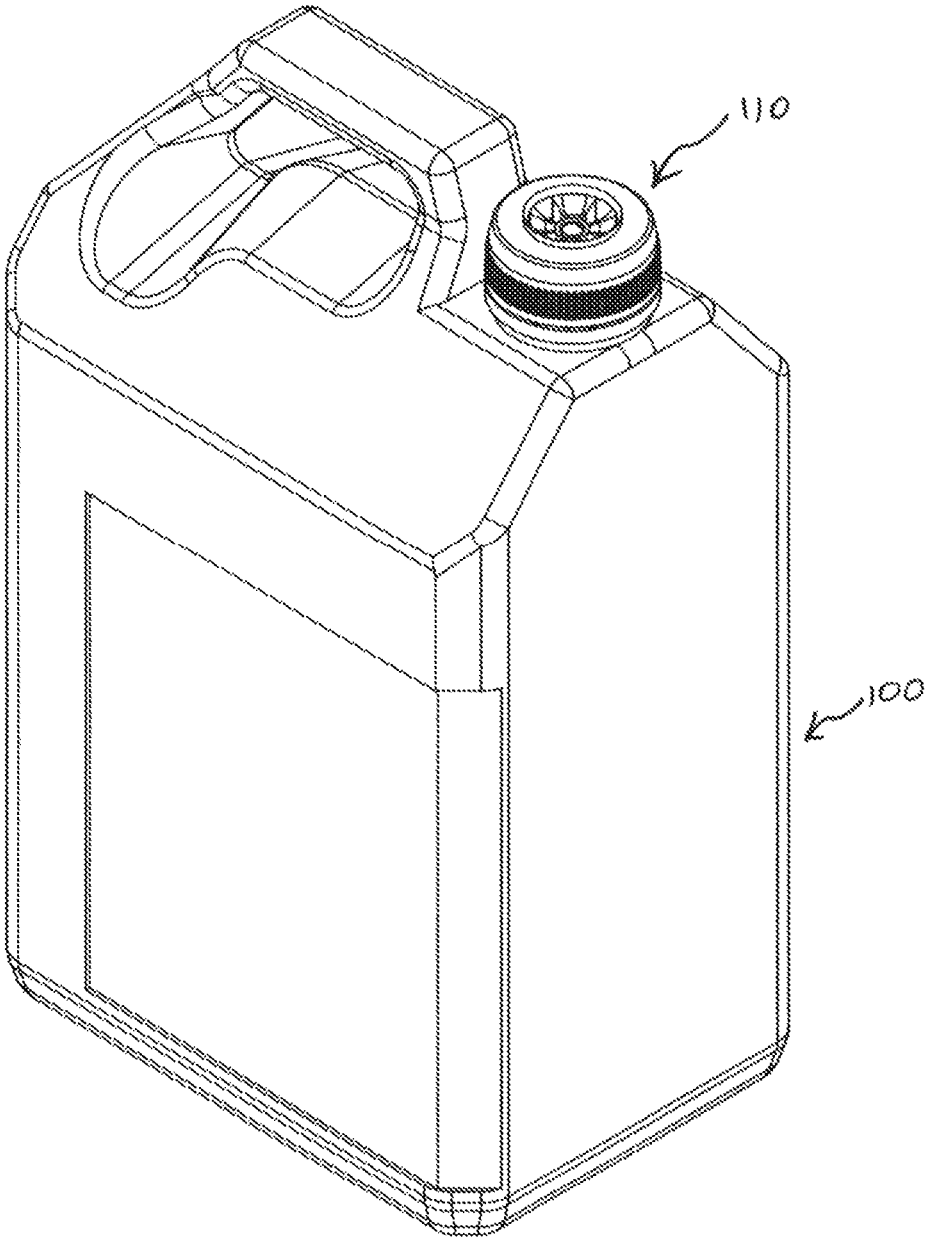
FIG. 1 is an illustration of a container shown in perspective view sealed by a cap in accordance with an embodiment of the present invention.

Referring to FIG. 1, container (100) is shown in perspective view with fitted cap (110) in accordance with an embodiment of the invention.

Cap (110) includes two components, inner member (111) and outer member (112) that are detailed and described in FIGS. 2 to 5 and 6 to 9, respectively.

Figure 2:
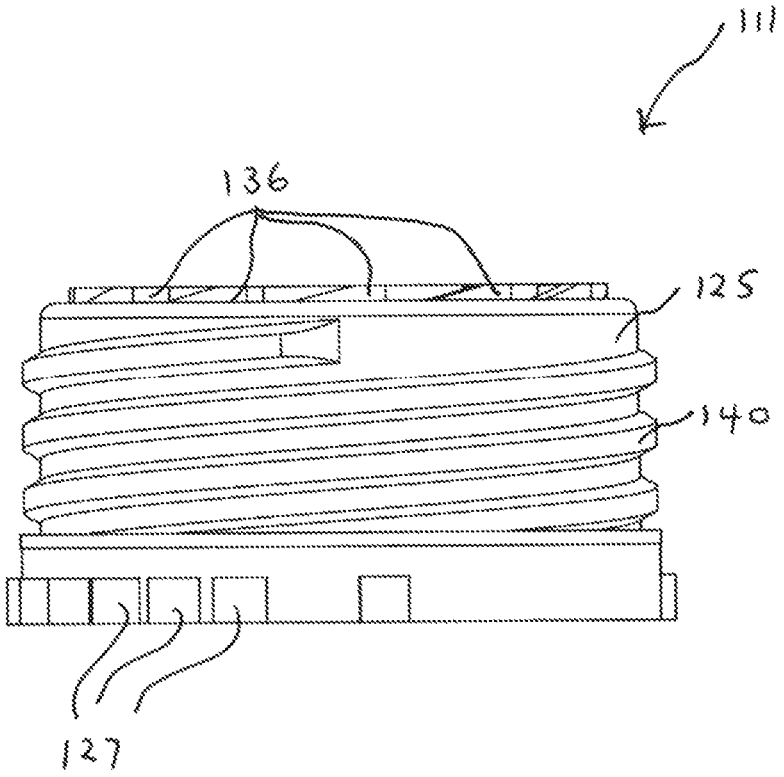
FIG. 2 illustrates a side view of the inner member of the cap shown in FIG. 1.

FIG. 2 details inner member (111) in side view in which thread (140) located on the external surface of rim (125) is shown that engages thread (144) located on an internal surface of rim (142) of outer member (112) (shown in FIGS. 6 to 9). Accordingly, inner member (111) and outer member (112) are in threaded connection and can be connected by rotating inner member (111) relative to outer member (112) to engage threads (140) and (144).

FIG. 2 also details guide lugs (136) the function of which will be described in further detail with reference to FIGS. 12 to 15 in which the inner member (111) and outer member (112) of cap (110) are shown in an engaged state.

FIG. 2 further details teeth (127) located on the external periphery of rim (125) that define a ratchet and which serve to prevent rotation of inner member (111) relative to outer member (112) so as to maintain cap (110) in a closed state prior to purchase and use. The function of teeth (127) and the way the ratchet defined by same will be described in further detail with reference to FIGS. 12 to 15 in which inner member (111) and outer member (112) of cap (110) are shown in an engaged state.

Figure 3:
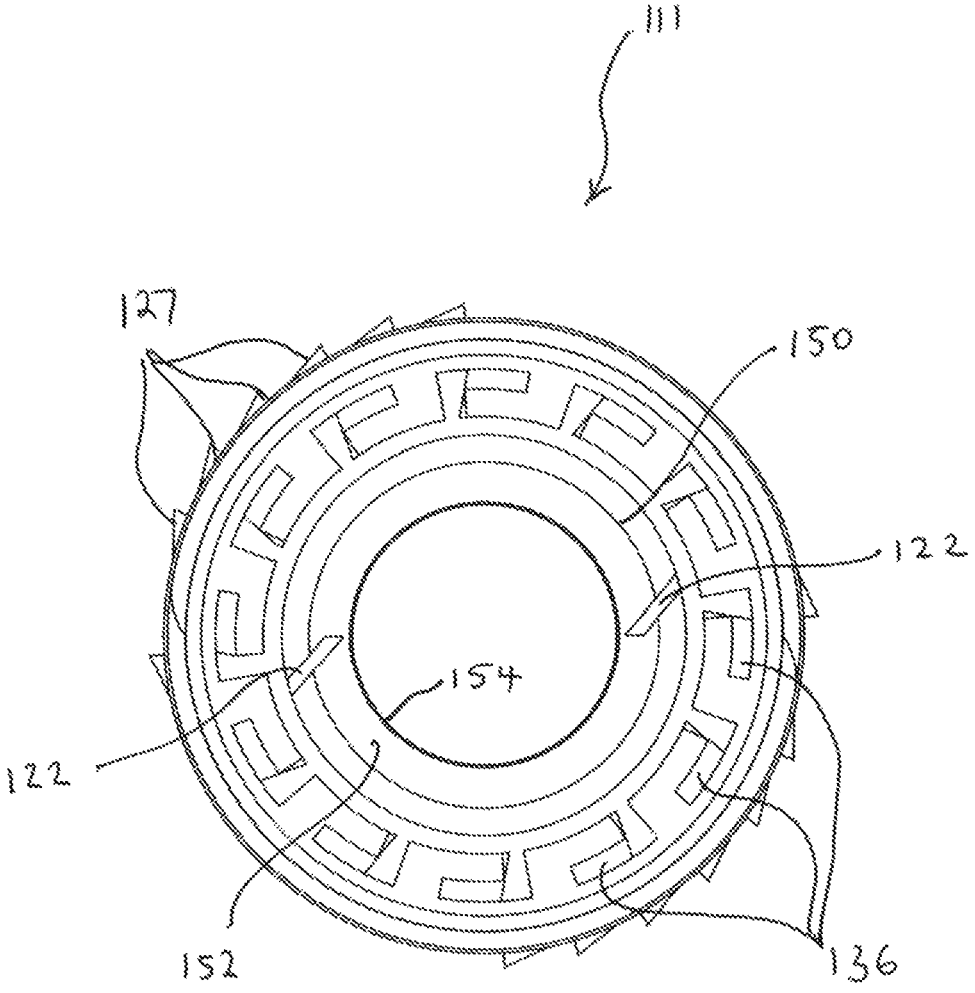
FIG. 3 illustrates a top view of the inner member of the cap shown in FIG. 1.

Inner member (111) is shown in top view in FIG. 3 which details teeth (127) located on the external surface of rim (125) (see FIG. 2) and also guide lugs (136) which engage corresponding drive lugs (134) located on outer member (112). The purpose, function and the way in which guide lugs (136) engage drive lugs (134) will be described in further detail with reference to FIGS. 12 to 15 in which inner (111) and outer (112) members are shown in an engaged state.

FIG. 3 also details flexible tongues (122) that engage projection (123—shown in FIG. 8) located on outer member (112) and that serves to prevent the removal of outer member (112) from inner member (111) as will be further described with reference to FIGS. 12 to 15.

FIG. 3 also details base portion (152) that extends radially inwardly a sufficient distance such that inner periphery (154) of base portion (152) forms part of a first seal between inner (111) and outer (112) members when outer member (112) is in a first (closed) position. The function of base portion (152) and how it functions as part of a first seal will be described in further detail with reference to FIG. 14.

Figure 4:
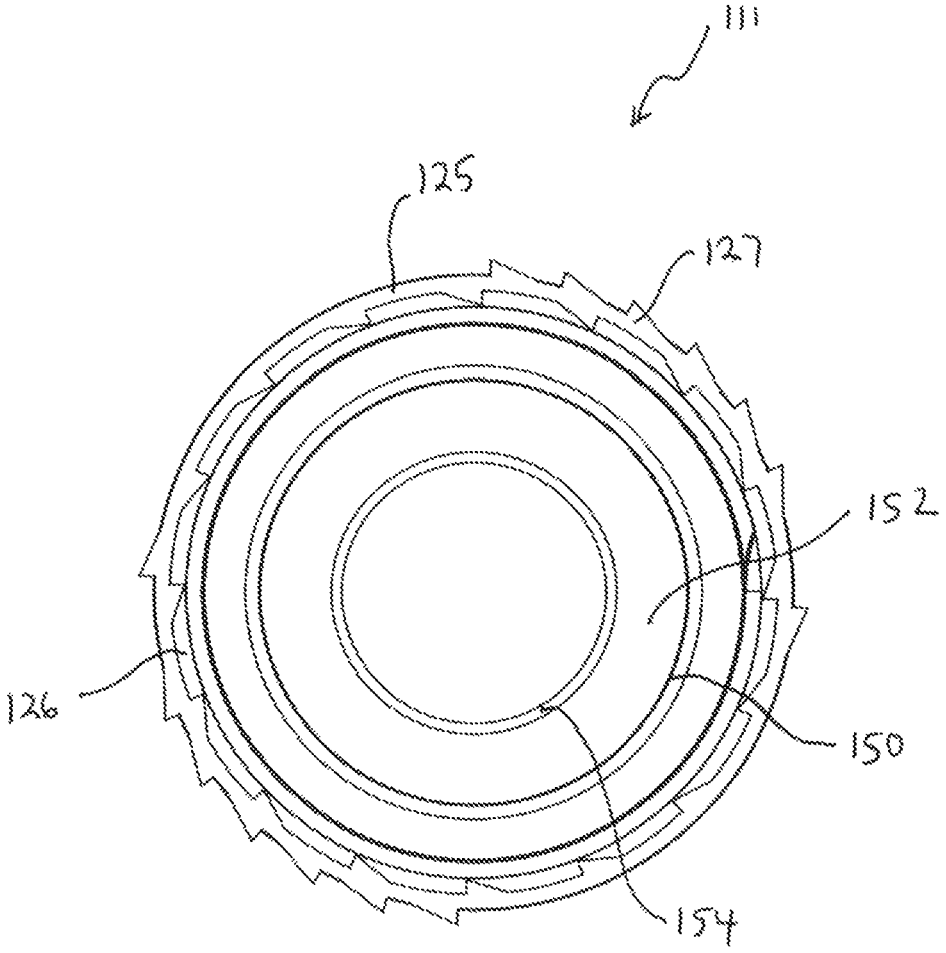
FIG. 4 illustrates a bottom view of the inner member of the cap shown in FIG. 1.

FIG. 4 shows a bottom view of inner member (111) in which teeth (127) are visible. FIG. 4 also details teeth (126) located on the internal surface of rim (125) that serve as another ratchet that prevents the removal of inner member from container (100) during use. The function of teeth (126) and the ratchet defined by same will be described in further detail with reference to FIGS. 12 to 15 that show inner (111) and outer (112) members in an engaged state.

FIG. 4 also shows internal annulus (150) that includes base portion (152) that extends radially inwardly a sufficient distance such that inner periphery (154) forms part of a first seal when it abuts the outer periphery (see FIG. 15) of base portion (132) located on outer member (112) when outer member (112) is in a first (closed) position.

Figure 5:
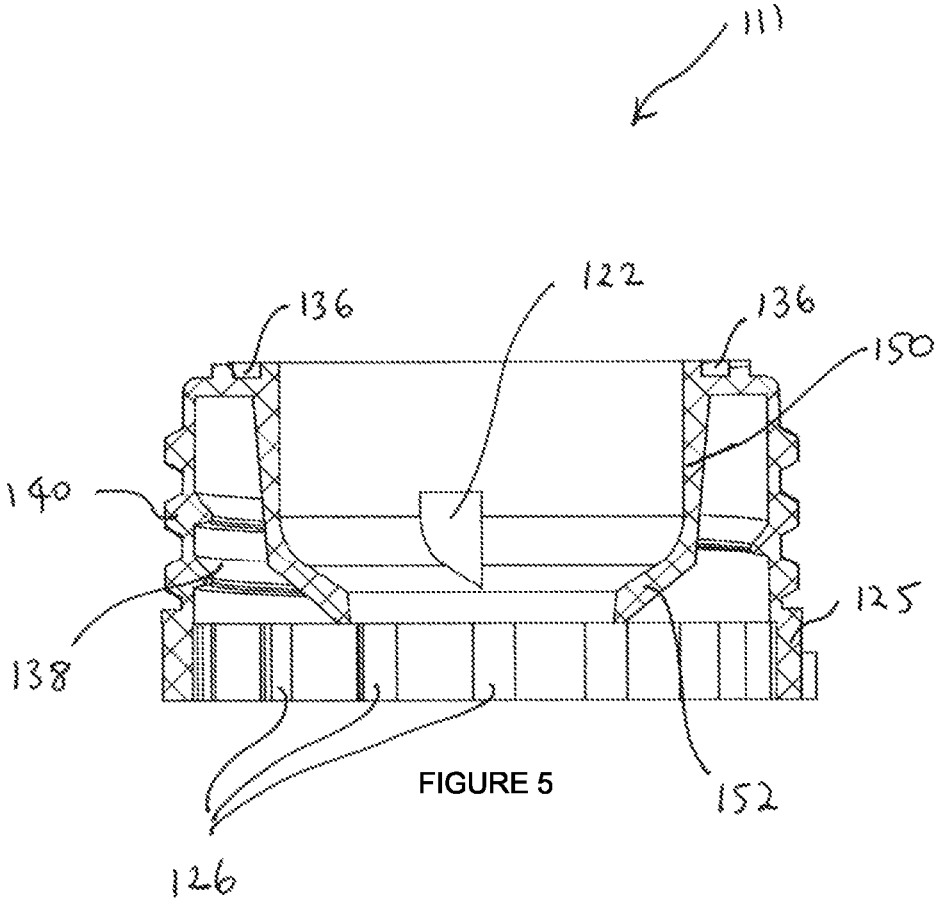
FIG. 5 illustrates a sectional view of the inner member of the cap shown in FIG. 1.

A side sectional view of inner member (111) is shown in FIG. 5 in which teeth (126) and guide lugs (136) are shown. FIG. 5 also details thread (138) located on the internal surface of rim (125) that engages a corresponding thread (not shown) located on container (100) to thereby secure inner member (111) to container (100). FIG. 5 also details thread (140) located on the external surface of rim (125) that serves to connect inner member (111) to outer member (112). FIG. 5 also details flexible tongue (122) used to prevent outer member (112) from being removed from inner member (111).

FIG. 5 also details internal annulus (150) which includes base portion (152) that forms part of a first seal (135—see FIG. 14)) when the inner periphery (154) of base portion (152) abuts the outer periphery (133—see FIG. 9) of base portion (132—see FIG. 9) of outer member (112) when outer member (112) is in a first (closed) position.

The features of outer member (112) will now be described with reference to FIGS. 6 to 9.

Figure 6:
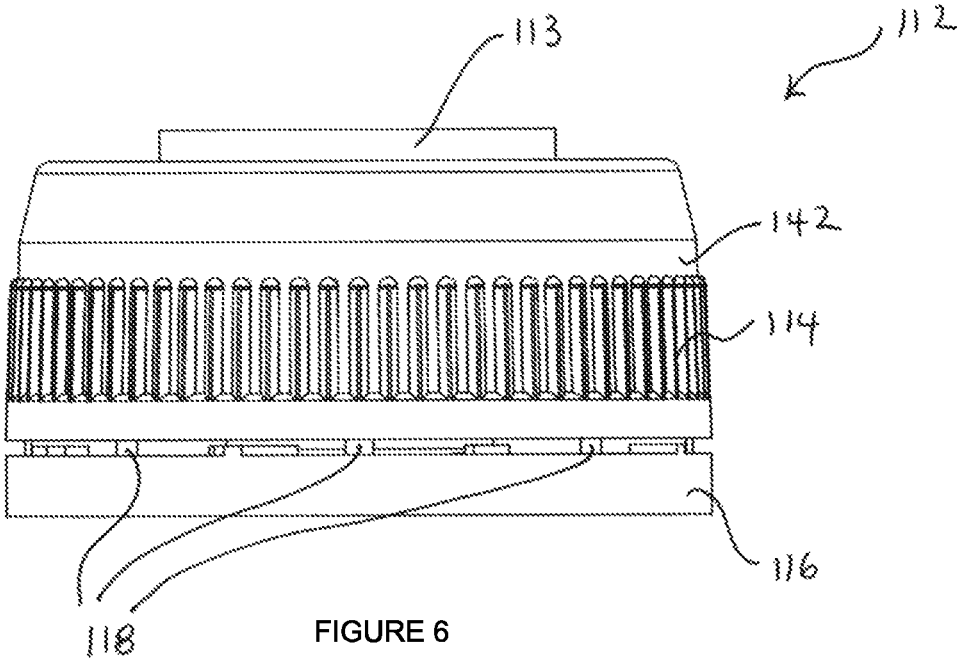
FIG. 6 illustrates a side view of the outer member of the cap shown in FIG. 1.

FIG. 6 shows a side view of outer member (112) detailing lip (113) that serves to prevent, or at least minimise, dripping of liquid during dispensing. FIG. 6 also details knurling (114) located on the external surface of rim (142). It will be appreciated that "knurling" represents a textured region on any surface that may include a pattern of straight, angled or crossed lines that are rolled, pressed, stamped or otherwise introduced onto a surface that serves to provide manual grip during movement of a part. In this embodiment, knurling (114) serves to provide manual grip of outer member (112) when it is moved (rotated) relative to inner member (111) in order to open the cap and allow dispensing of fluid. Knurling (114) also serves to provide mechanical grip when outer member (112) is engaged with inner member (111) and the assembled cap is driven onto container (100) by the use of a conventional capping chuck.

FIG. 6 further details bridges (118) that connect tamper ring (116) to rim (142) of outer member (112).

Figure 7:
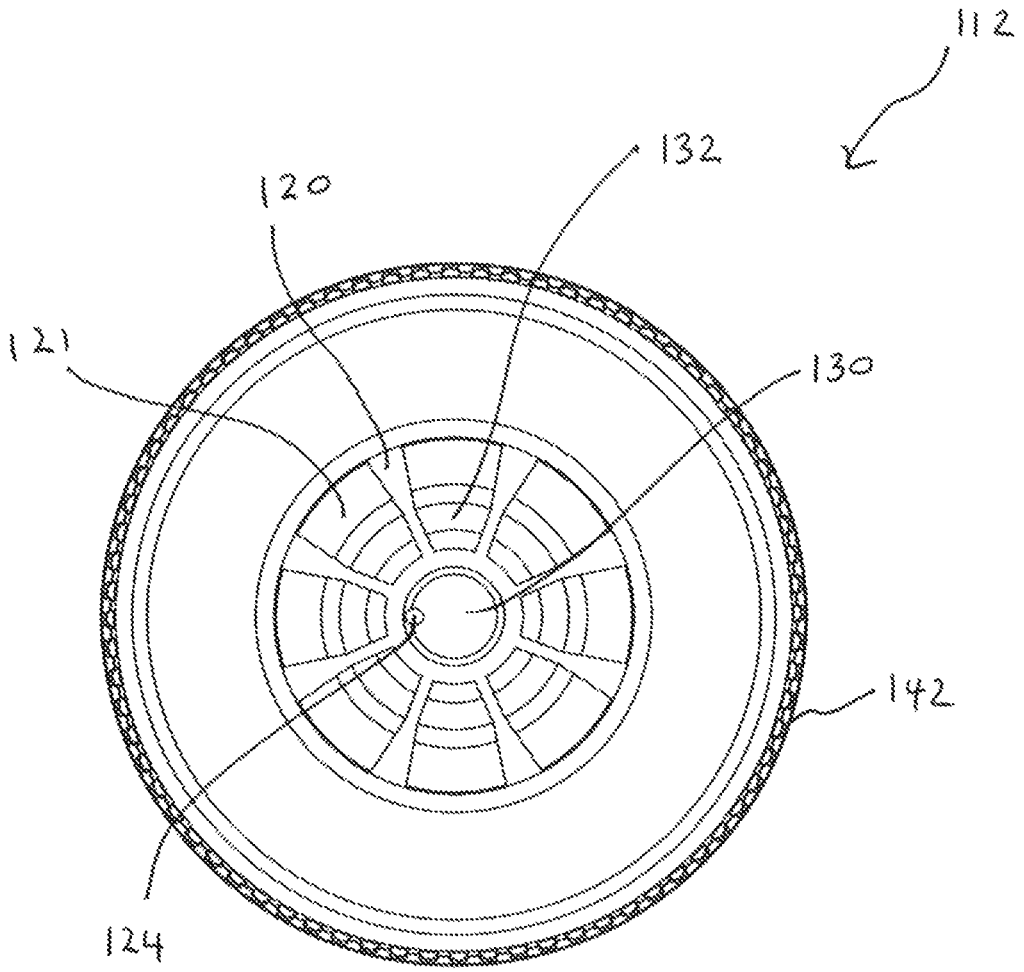
FIG. 7 illustrates a top view of the outer member of the cap shown in FIG. 1.

A top view of outer cap (112) is shown in FIG. 7 that details knurling (114) located on rim (142). Ribs (120) arranged in a spoke arrangement are also detailed which define flow channels (121) through which liquid exits and/or air enters container (100) during dispensing. The function of ribs (120) and flow channels (121) is further described with reference to FIGS. 10 to 15 and also FIGS. 29 to 31.

Figure 9:
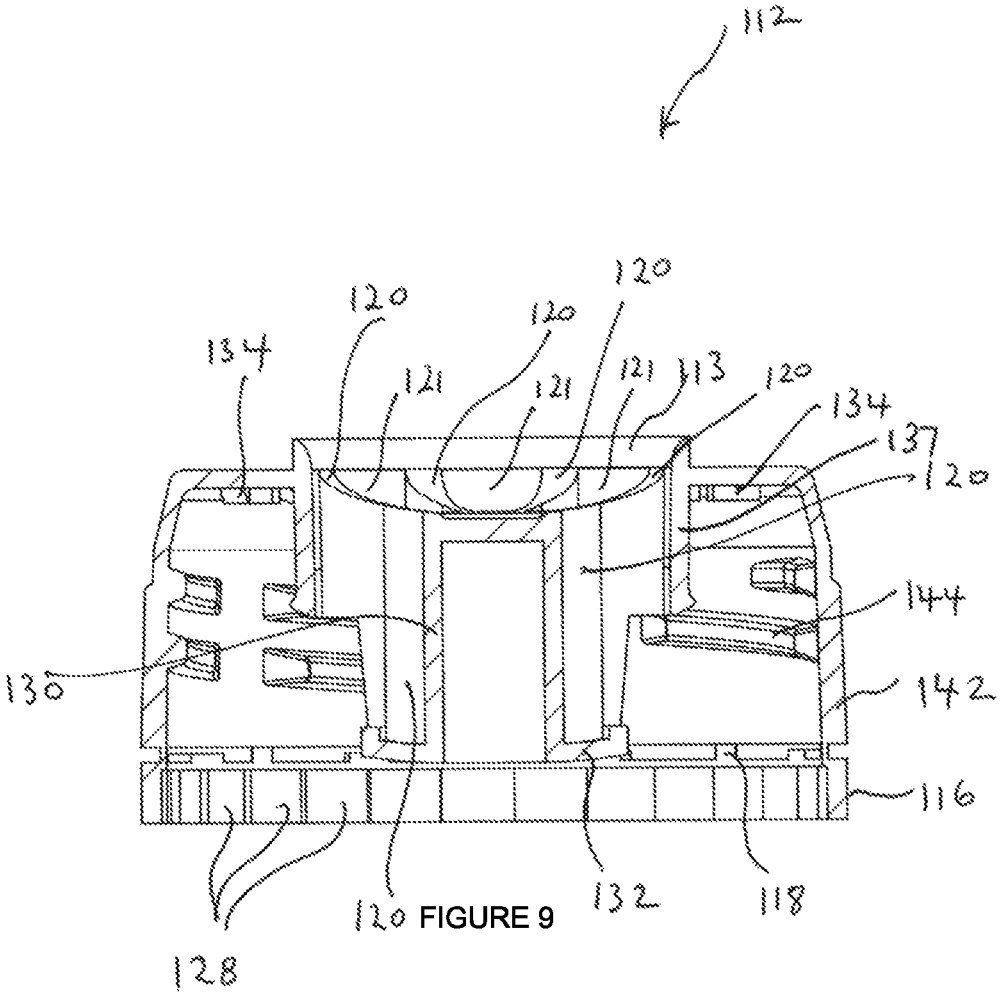
FIG. 9 illustrates a sectional view of the outer member of the cap shown in FIG. 1.

FIG. 7 also details top portion (131) and base portion (132) of central support structure (130—shown in FIG. 9). Central support structure (130) serves to support ribs (120) and also functions as part of a first seal that substantially prevents the flow of liquid when outer member (112) is in a first (closed) position. Central support structure also includes wall (137—shown in FIG. 9) that forms part of a second seal and that will be described in further detail with reference to FIG. 15.

FIG. 7 also details vent hole (124) which is an optional feature that is adopted when liquids that require continuous venting are stored in container (100). The function of vent hole (124) is further described with reference to FIG. 13 that shows a top view of cap (110) when in an assembled state in which inner member (111) is connected, by threaded connection, to outer member (112).

Figure 8:
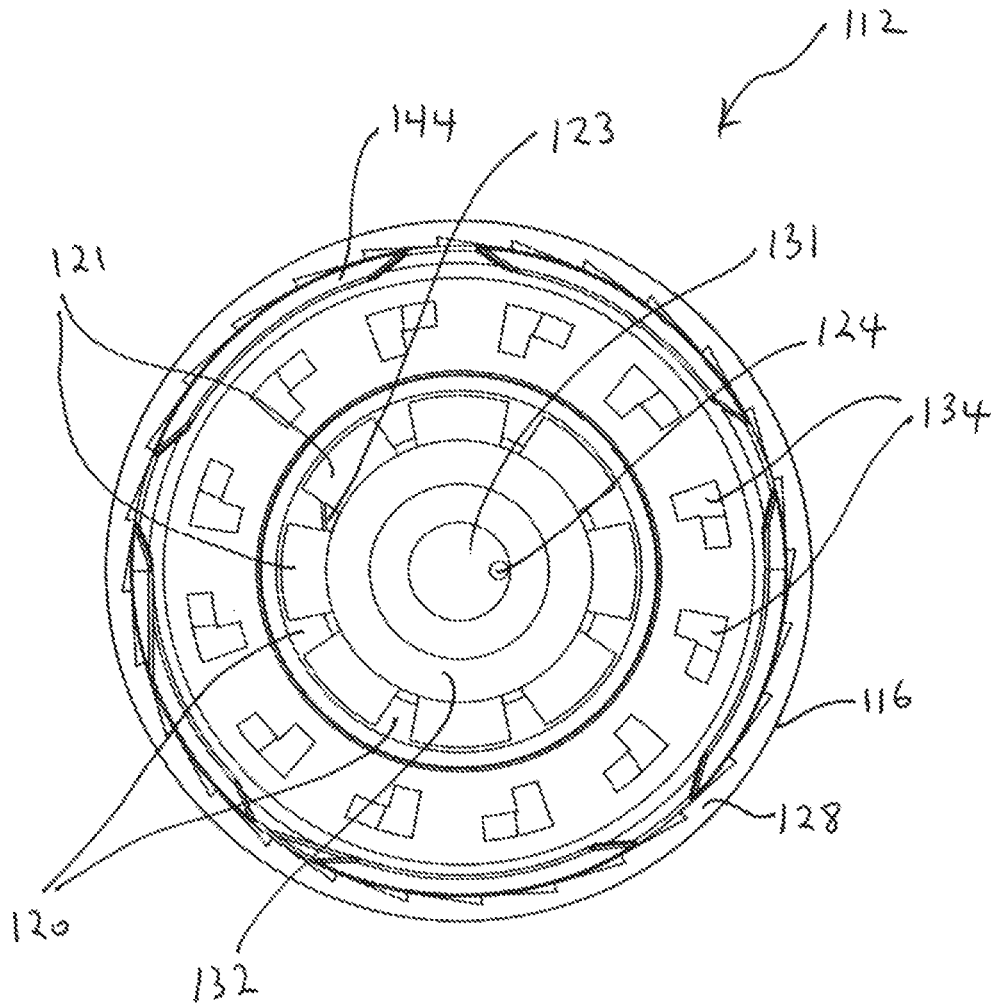
FIG. 8 illustrates a bottom view of the outer member of the cap shown in FIG. 1.

FIG. 8 shows outer member (112) in bottom view detailing teeth (128) that define a ratchet located on the internal surface of tamper ring (116). Also detailed are ribs (120) that define flow channels (121) (flow channels (121) defined by ribs (120) are more clearly illustrated in FIG. 11). Thread (144) located on the internal surface of rim (142) is also shown in addition to vent hole (124) located on top portion (131) of central support structure (130—shown in FIG. 9). Also shown is base portion (132) located on central support structure (130—shown in FIG. 9).

FIG. 8 also details drive lugs (134) the function of which are described in detail with reference to FIGS. 12 to 15 that show cap (110) in an assembled state in which inner member (111) is connected, by threaded connection, to outer member (112).

A side sectional view of outer member (112) is shown in FIG. 9 in which lip (113) and ribs (120) are shown. Ribs (120) are connected to central support structure (130) which includes a top portion (131) and also a base portion (132). Base portion (132) serves to form part of a first seal and thereby substantially prevents the flow of liquid when outer member (112) is in a first (closed) position. The function of the first seal is further described with reference to FIGS. 12 to 15 which detail cap (110) when in an assembled state in which inner member (111) is connected, by threaded connection, to outer member (112).

Also detailed in FIG. 9 is thread (144) located on an internal surface of rim (142) of outer member (112) that serves to connect, via threaded connection, inner (111) and outer (112) members.

FIG. 9 further details drive lugs (134) the function of which are described in detail with reference to FIGS. 12 to 15 that show cap (110) in an assembled state in which inner member (111) is connected, by threaded connection, to outer member (112).

Figure 10:
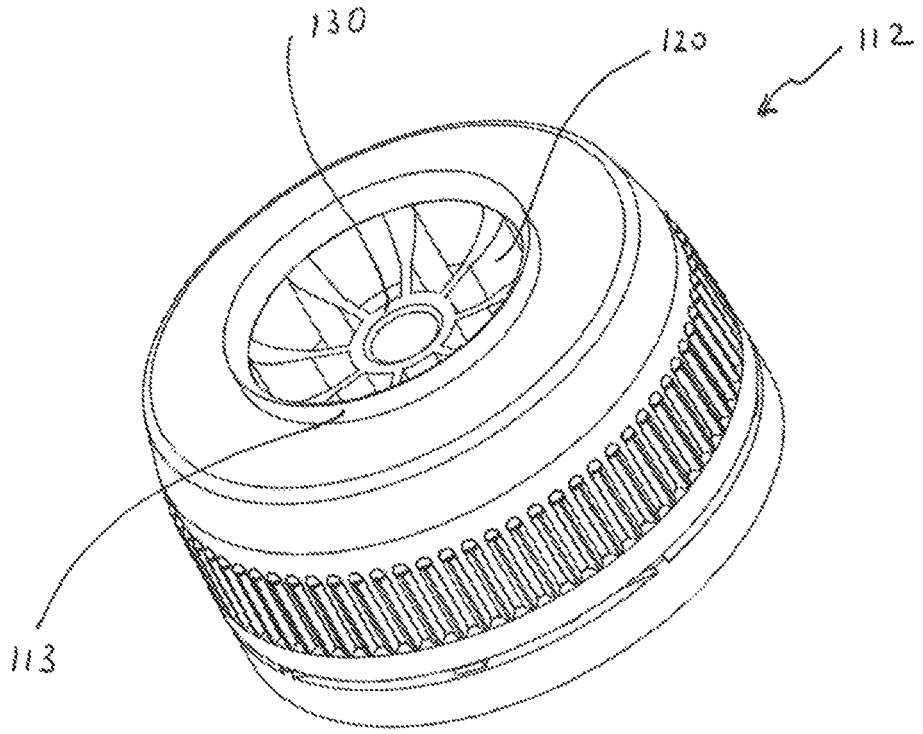
FIG. 10 illustrates a perspective view of the outer member of the cap shown in FIG. 1.

FIG. 10 shows outer member (112) in perspective view in which the configuration of ribs (120) in relation to lip (113) may be observed. As can be seen from this figure, ribs (120) have an upward curvature as they extend radially outward from central support structure (130) towards the outer periphery of outer member (112). The upward curvature of ribs (120) cause the end of ribs (120) to meet the base of lip (113) to thereby smoothly transition the surface of the ribs (120) to the surface of lip (113) and thereby provide a smooth surface over which liquid may travel during egress from the container and dispensing opening of cap (110) upon sufficient tilting of the container. It will be appreciated that the smooth transition of the surface of the ribs (120) to the surface of the lip (113) may assist in achieving more even flow of liquid over ribs (120) and lip (113) during dispensing of the container contents thereby avoiding, or ameliorating splashing and/or dripping of liquid.

Figure 11:
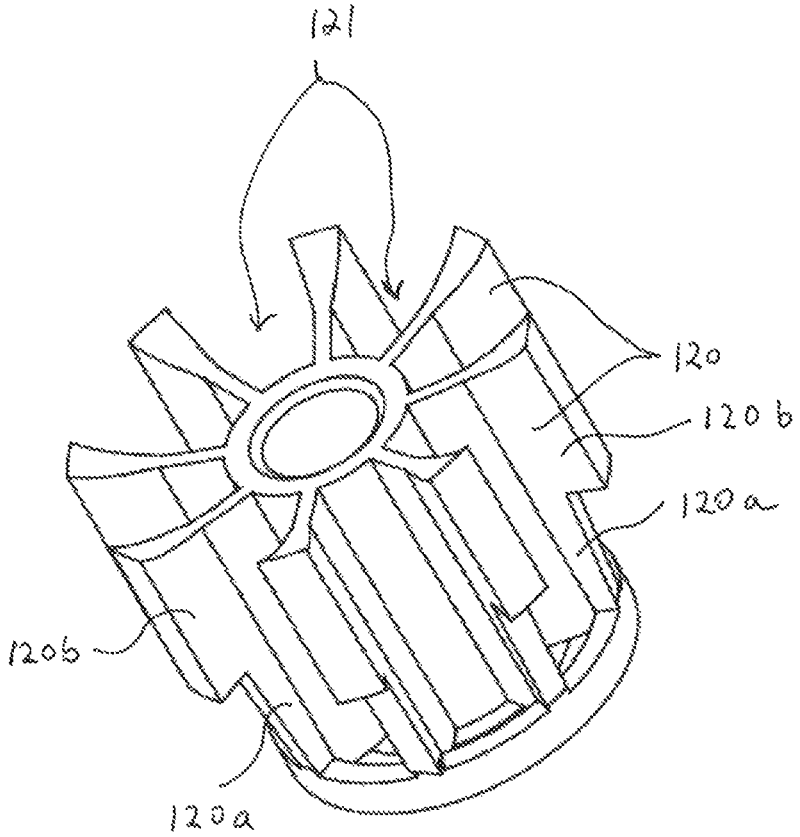
FIG. 11 illustrates a perspective view of the internal spoke arrangement within the outer member of the cap shown in FIG. 1.

FIG. 11 details a perspective view of the internal rib spoke arrangement of outer member (112) in which the wall of outer member (112) has been removed to more clearly illustrate the internal spoke arrangement of ribs (120) and how the configuration of ribs (120) define a plurality of flow channels (121). As can be seen in FIG. 11, each of ribs (120) have a notched (or cut-away) section thereby defining portion (120*a*) that is of a narrower width dimension as compared with portion (120*b*). In this regard, it will be appreciated that "narrow" portion (120*a*) on each of ribs (120) permits the entry of liquid into the spoked rib arrangement of outer member (112) when cap (110) is in an "open" state to thereby permit dispensing of liquid from the container through dispensing opening of cap (110). The "wider" portion (120*b*) of rib (120) is of a width dimension that is sufficient to cause the edge of rib (120) to abut the internal wall surface of cap (110) such that two adjacent spaced apart ribs (120), central support structure (130) and the internal surface of outer member (112) wall define an enclosed flow channel (121). It will be appreciated that the ribs (120) in combination with the internal surface of the outer member (112) wall and central support structure (130) increase the surface area of outer member (112) with which liquid comes into contact during egress from the container through cap (110). In this regard and without seeking to be bound by theory, it is considered that flow channels (121) serve to slow down the rate of liquid flow through frictional resistance as the liquid egresses from the container, especially in regions where the liquid comes into contact with the surface of ribs (120), central support structure (130) and the internal surface of outer member (112) wall. Accordingly, it is considered that ribs (120), by forcing the liquid to enter one or more flow channels (121) during egress from the container through cap (110), effectively increases the contact surface area between the liquid and outer member (112) thereby slowing the rate of liquid flow and mitigating the "glugging" effect during dispensing of liquid from the container.

Figure 12:
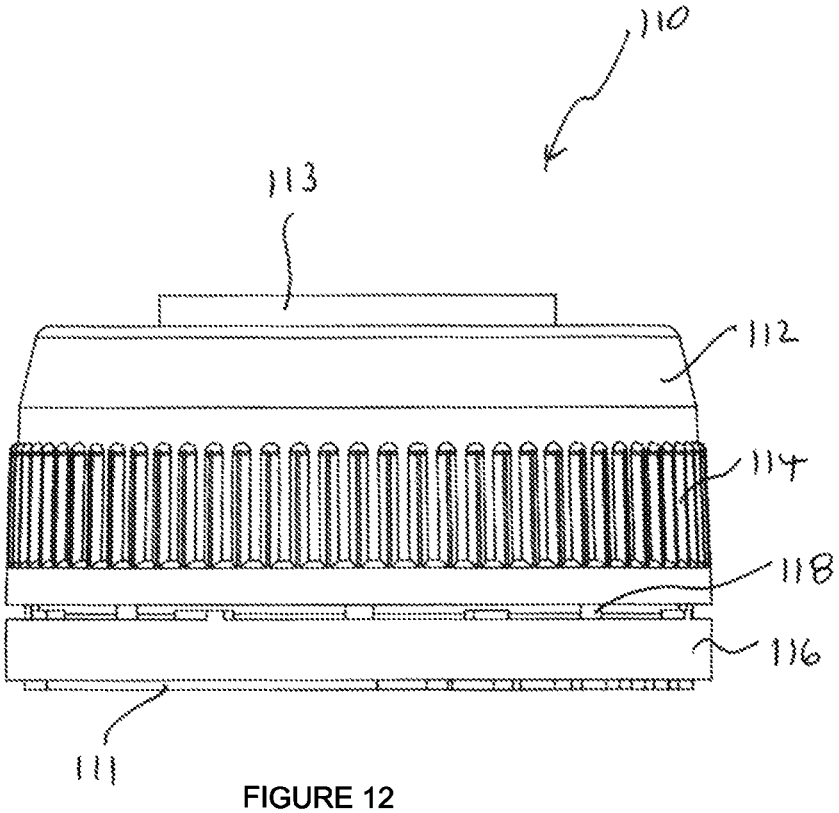
FIG. 12 illustrates a side view of the cap shown of FIG. 1 in which the inner and outer members of the cap are in an engaged state.
Figure 13:
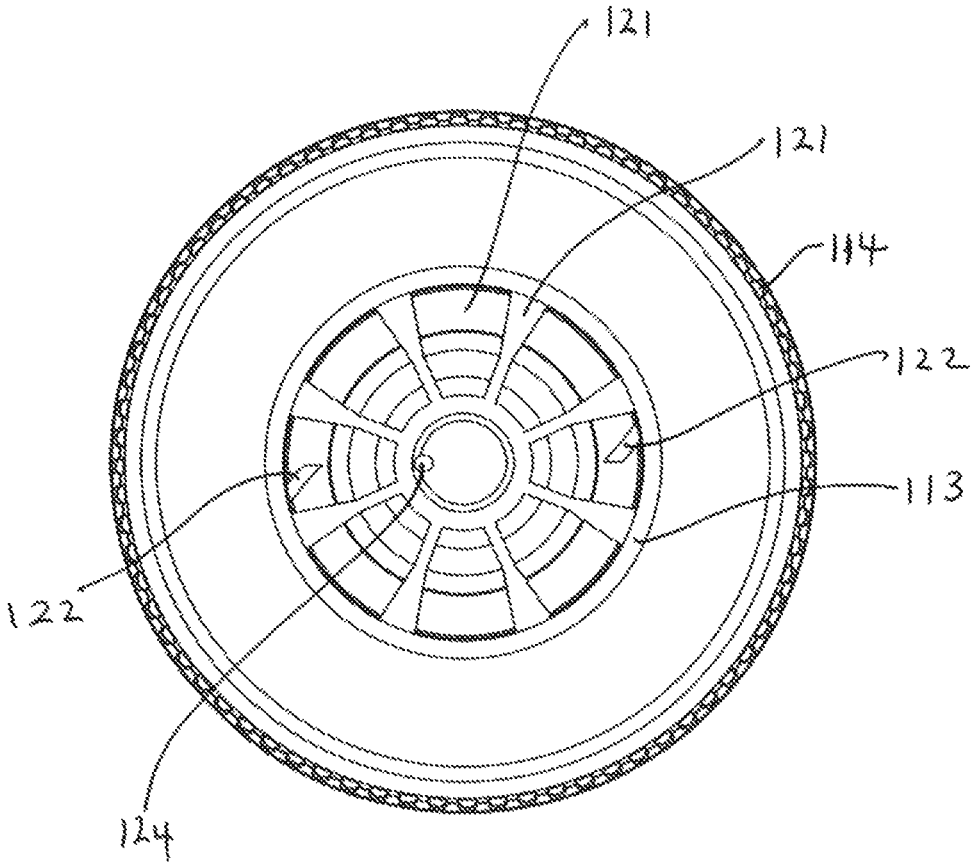
FIG. 13 illustrates a top view of the cap shown in FIG. 1 in which the inner and outer members of the cap are in an engaged state.
Figure 14:
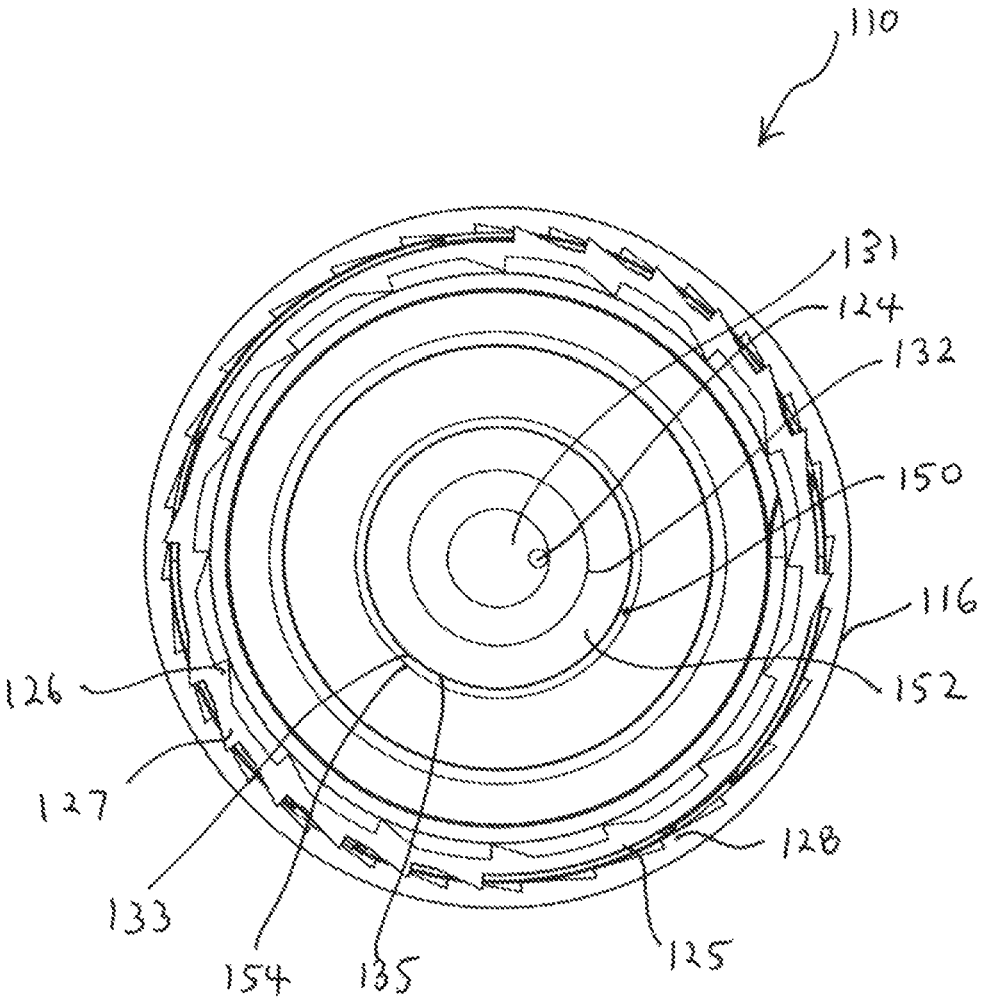
FIG. 14 illustrates a bottom view of the cap shown in FIG. 1 in which the inner and outer members of the cap are in an engaged state.
Figure 15:
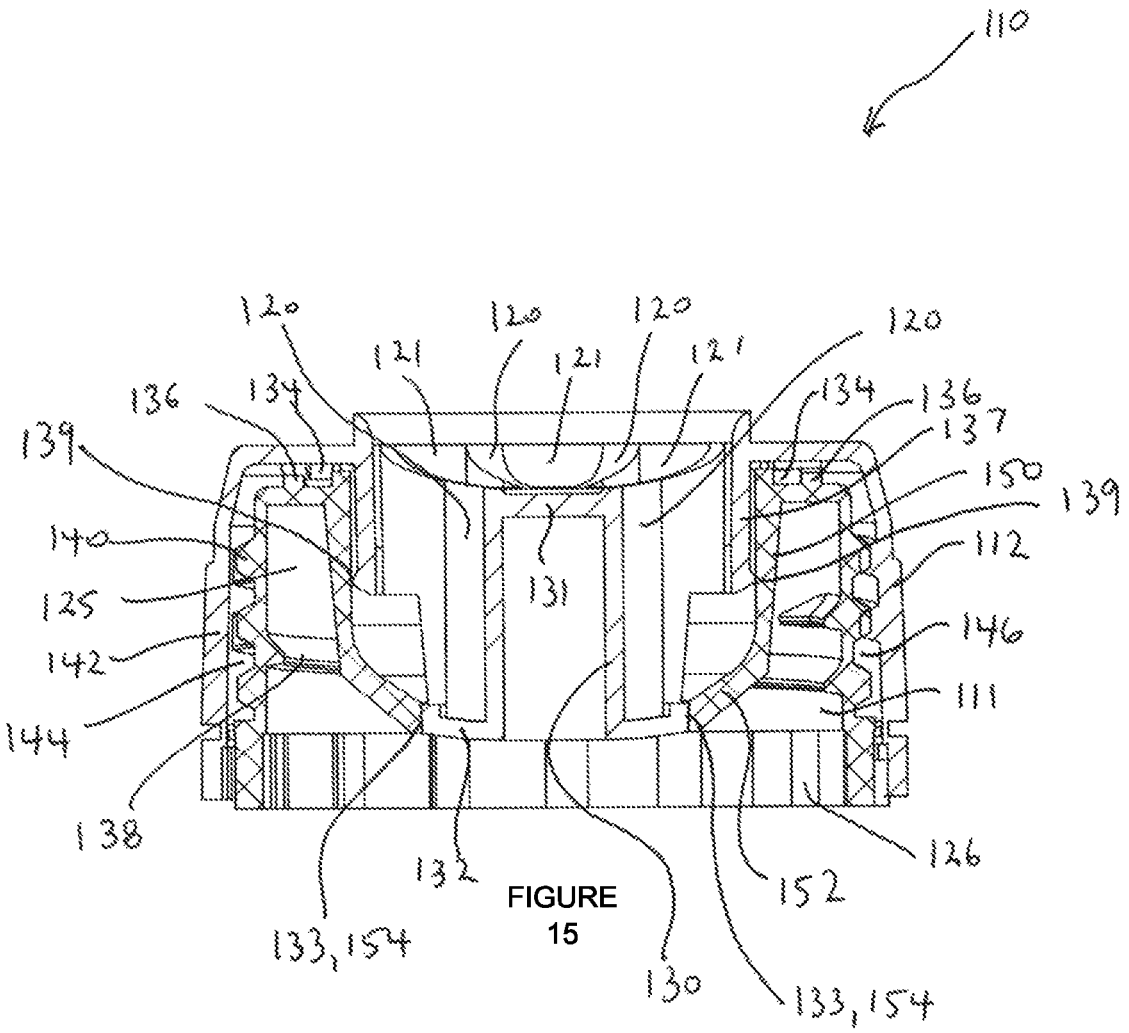
FIG. 15 illustrates a sectional view of the cap shown in FIG. 1 in which the inner and outer members of the cap are in an engaged state.

The relationship between inner member (111) and outer member (112) when the cap (110) is in an engaged state is shown in FIGS. 12 to 15 and, in particular, the sectional view shown in FIG. 15. With reference to FIG. 12, cap (110) is shown in side view detailing outer member (112) that includes lip (113) that prevents, or at least minimises, any excess dripping of the liquid contents during dispensing. Outer member (112) also details knurling (114) surrounding the external surface of rim (115) of outer member (112).

FIG. 12 also shows tamper ring (116) connected to outer member (112) by a series of bridges (118) that may be broken by the manual application of a force when the cap (110) is used and opened for the first time. Upon breakage of bridges (118), outer member (112) is able to be moved (rotated) relative to inner member (111) from a first (closed) position to a second (open) position to thereby open cap (110) and enable fluid contained within container (100) (shown in FIG. 1) fitted with cap (110) to be dispensed from container (100).

Cap (110) is shown in top view in FIG. 13, detailing, once again, lip (112) and knurling (114) located on outer member (112). Outer member (112) also includes ribs (120) disposed in a spoke arrangement (refer also to FIG. 11) which defines a plurality of flow channels (121) through which liquid passes during dispensing of the liquid from container (100) shown in FIG. 1. Ribs (120) serve to avoid, or at least ameliorate, any surging "glugging" of liquid as it passes and exits through cap (110) during dispensing of the contents of container (100). In this regard, and without seeking to be bound by theory, it is considered that the "glugging" effect that is normally observed during pouring of a liquid from a container is mitigated by ribs (120) which serve to disrupt and retard the liquid flow rate to a point that is sufficient to avoid or at least reduce any surging "glugging" of the liquid. Ribs (120) also facilitate the entry of air back into the container during dispensing to thereby equalise the internal and external pressure with respect to the container and thereby permit and/or promote liquid flow from the container.

Whilst it is possible to configure the cap so that any number flow channels (121) are defined, a passage defining 8 channels arranged in a spoke arrangement is preferred since this provides sufficient flow area for the passage of liquid out of the container through dispensing opening of cap (110) yet also provides sufficient surface area of ribs (120) such that the flow of liquid is sufficiently retarded through frictional contact of the liquid with the surface of ribs (120) to thereby mitigate "glugging" of the liquid as it exits container (100) through dispensing opening of cap (110).

It will be understood that the use of ribs (120) that facilitate the entry of air back into the container during dispensing avoids the need to puncture the container during use so as to permit and/or promote liquid flow. The avoidance or mitigation of "glugging" of the liquid also results in a more controlled flow of liquid that prevents or minimises the risk of spillage of any liquid during dispensing. Both of these factors are beneficial from an occupational health and safety perspective, particularly in respect of circumstances in which hazardous, toxic and/or flammable liquids are dispensed from a container.

FIG. 13 also details flexible tongue (122) located on outer member (112) that prevents removal of outer member (112) from inner member (111) after assembly and during use in the absence of the application of excessive force, wherein flexible tongue (122) is pushed past projection (123—shown in FIG. 8) during assembly of inner member (111) and outer member (112).

Outer member (112) further includes, in this embodiment, optional vent hole (124) that is useful when liquids that require continuous venting are stored within container (100). In this regard, it is noted that many industrial liquids and reagents stored in containers can cause the containers to expand or even explode during transportation and storage and thereby require the use of one or more vent holes which are designed to enable the container to "breathe" and thereby equalize pressure within the container preventing distortion and damage of the container. In order to isolate the container contents from the external environment and prevent any leakage or spillage of liquid during transport, storage and dispensing of liquid, porous discs may be placed within vent holes (124) that enables container (100) to breathe. Such porous discs are known and readily available.

Referring now to FIG. 14, a bottom view of cap (110) is shown that details vent hole (124) located on outer member (112). FIG. 14 also details tamper ring (116) connected to outer member (112) of which only the top portion (131) of the central support structure (130—see FIG. 15) of outer member (112) is visible.

FIG. 14 also details dual ratchet systems adopted with cap (110) that each serve to secure inner member (111) to container (100) and also avoids a user tampering with the contents of container (100) prior to purchase and/or use. In this regard, it will be appreciated that a ratchet broadly defines any mechanical device that allows continuous rotary motion of a part only in one direction whilst preventing motion of the part in the opposite direction.

The first ratchet system includes a plurality of teeth (126) located on an internal surface of the periphery of rim (125) of inner member (111), wherein the plurality of teeth (126) engage one or more pawls located on the neck of container (100) (not shown). The one or more pawls located on the neck of container (100) prevent rotation of inner member (111) in a direction that would disengage inner member (111) from container (100). That is, teeth (126) located on inner member (111) and pawls (not shown) located on the neck of container (100) permit rotation of inner member only in one direction to thereby engage and secure inner member (111) to container (100) during installation of cap (110). Accordingly, once inner member (111) and/or cap (110) is installed on container (100), removal of inner member (111) and/or cap (110) is not possible unless excessive force is applied which would likely damage inner member (111) and/or container (100).

The second ratchet system includes a plurality of teeth (127) located on an external surface of the periphery of rim (125) of inner member (111) wherein plurality of teeth (127) engage one or more teeth (128) located on an internal surface of tamper ring (116). Accordingly, whilst bridges (118—shown in FIG. 12) remain intact, rotation of outer member (112) relative to inner member (111) is restricted thereby preventing outer member (112) to be moved from an first (closed) position to a second (open position). Upon breakage of bridges (118) by the manual application of a force when the cap is used and opened for the first, outer member (112) is then able to be moved (rotated) relative to inner member (111) from a first (closed) position to a second (open) position to thereby open cap (110) and enable fluid contained within container (100) to be dispensed from container (100).

FIG. 14 also shows internal annulus (150) within internal member (111) having base portion (152) that extends radially inwardly a sufficient distance such that inner periphery (154) of base portion (152) forms part of a first seal (135) and abuts outer periphery (133) of base portion (132) of support structure (130—shown in FIG. 15) when outer member (112) is in a first (closed) position.

FIG. 15 is a sectional view of cap (110) showing inner member (111) and outer member (112) in an engaged state. FIG. 15 details teeth (126) located on an internal surface of the periphery of rim (125) that form part of a first ratchet system as previously described. FIG. 15 also details thread (138) located on an internal surface of rim (125) of inner member (111) that serves to engage, by threaded connection, inner member (111) to the neck of container (100) (not shown). FIG. 15 further details thread (140) located on an external surface of rim (125) of inner member (111) that serves to engage inner member (111) to outer member (112) by threaded connection to thread (144) located on an internal surface of rim (142) of outer member (112).

FIG. 15 also details ribs (120) that, as previously discussed, serve to avoid or at least ameliorate the "glugging" of liquid as it exits container (100) during dispensing, and which also serve to permit air flow back into container (100) during dispensing thereby permitting and/or promoting liquid flow without having to puncture container (100).

In an embodiment, cap (110) is installed on container (100) whilst assembled, that is, when the inner (111) and outer (112) members are in an engaged state, using an automatic capping machine. Such machines allow for continuous capping of containers using one or multiple chuck heads and are ideal for use in facilities with high volume production.

In order to install cap (110) on container (100), the chuck of a conventional capping machine (not shown) grips outer member (112) of cap (110) and positions same over the neck (not shown) of container (110). Whilst not shown in any one of FIGS. 1 to 15, it will be appreciated the opening of container (100) includes a neck portion on which a thread is located on the external surface that is able to engage thread (138) located on the internal surface of rim (125) of inner member (111). In order to engage and secure cap (110) on container (100), capping chuck rotates cap (110) in a direction that serves to engage thread (138) of inner member (111) with the thread located on the neck of container (100).

In order to avoid binding (seizing) and/or damage of the threads of inner (111) and outer (112) members of cap (110), drive lugs (134) located on outer member (112) (see also FIG. 8) engage and interlock guide lugs (136) (see also FIG. 3) located on inner member (111) which drive inner member (111) and engage same with the thread located on the neck of container (100) without applying excess pressure on the threads connecting inner and outer members. It will be appreciated that avoiding applying excess pressure on the thread mechanism between inner (111) and outer (112) members serves to avoid, or at least minimises, the risk of damage to the threaded connection and thereby minimises the risk of any leakage of liquid contents during storage, transport or dispensing of the container liquid content. Once again, this is beneficial from an occupational health and safety perspective, particularly in circumstances in which hazardous liquids are stored within, and are dispensed from, container (100).

FIG. 15 also shows first seal formed between outer periphery (133) of base portion (132) of outer member (112) and inner periphery (154) of base portion (152) of inner member (111). It will be understood that first seal serves to substantially prevent the flow and exit of liquid out of container (100) when outer member (112) is in a first (closed) position.

FIG. 15 further shows second seal (139) formed between wall (137) that abuts the wall of internal annulus (150) wherein second seal (139) substantially diverts liquid to flow to channels (121) and away from the cavity defined between inner (111) and outer (112) members that house the thread mechanism.

Figure 16:
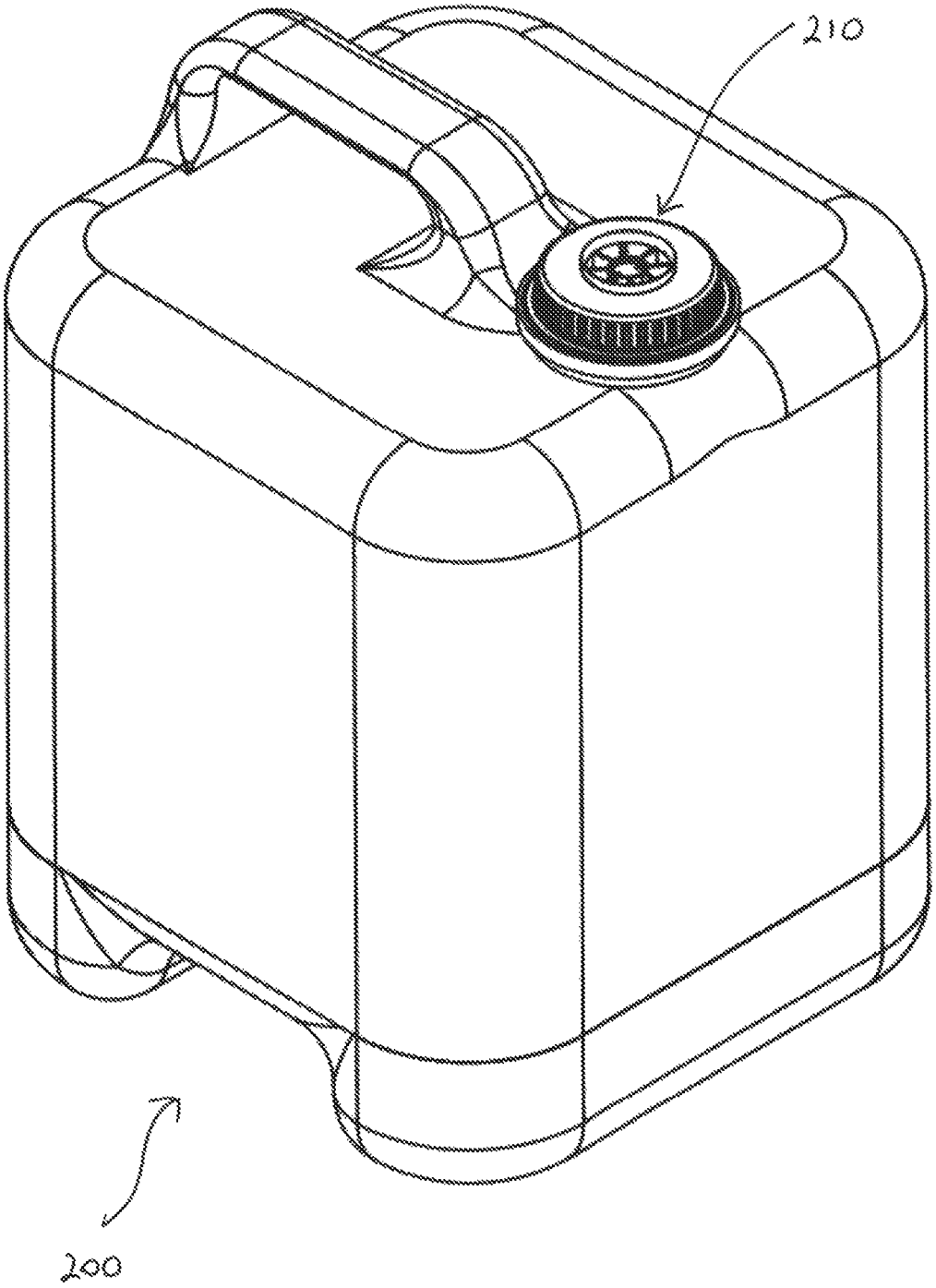
FIG. 16 is an illustration of a container shown in perspective view sealed by a cap in accordance with an alternative embodiment of the present invention.

Referring to FIG. 16, container (200) is shown in perspective view with fitted cap (210) in accordance with an embodiment of the invention.

Cap (210) includes two components, inner member (211) and outer member (212) that are detailed and described in FIGS. 17 to 20 and 21 to 24, respectively.

Figure 17:
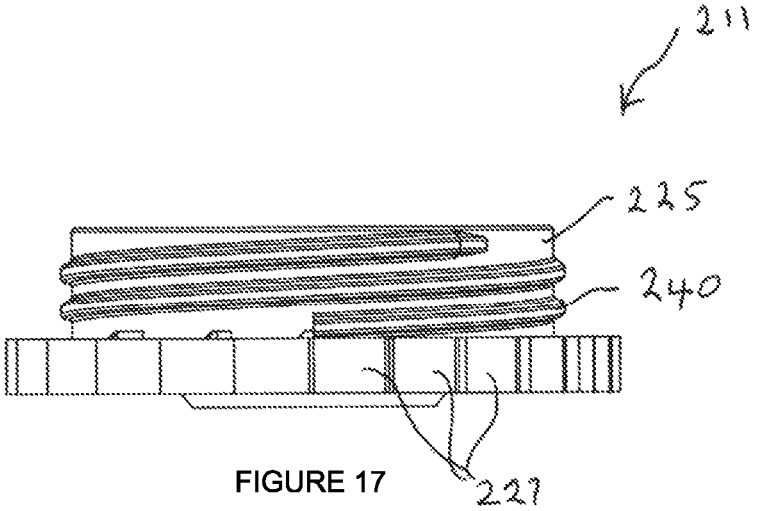
FIG. 17 illustrates a side view of the inner member of the cap shown in FIG. 16.
Figure 24:
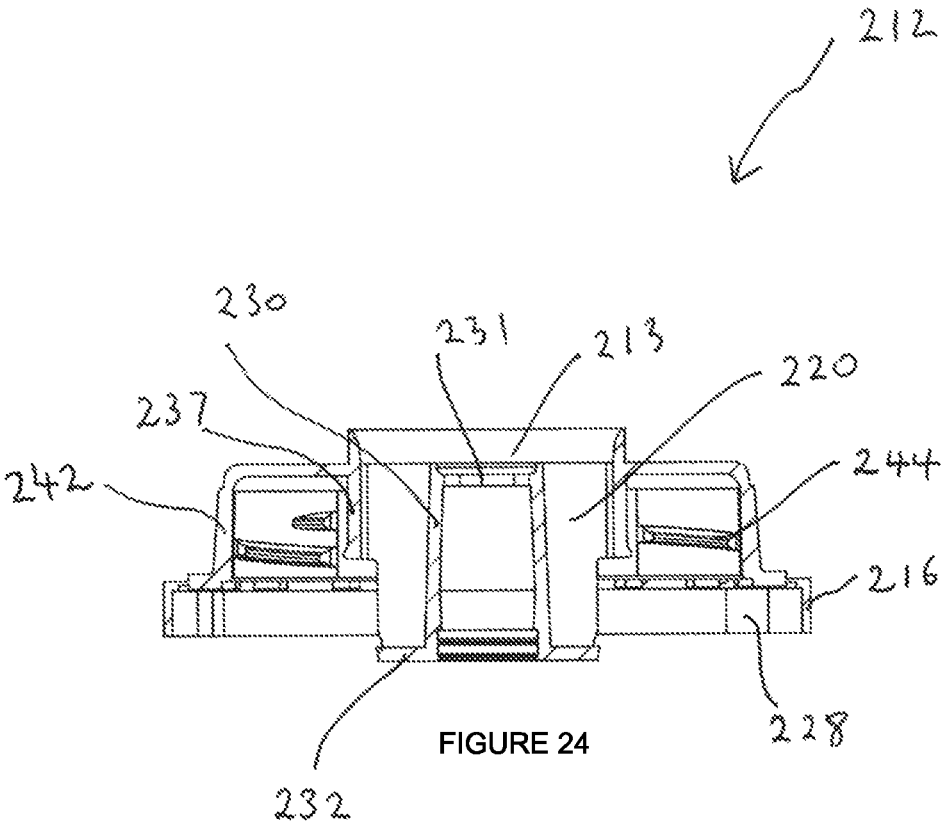
FIG. 24 illustrates a side view of the cap shown of FIG. 16 in which the inner and outer members the cap are in an engaged state.

FIG. 17 details inner member (211) in side view in which thread (240) located on the external surface of rim (225) is shown that engages thread (244) located on an internal surface of rim (242) of outer member (212) (shown in FIG. 24). Accordingly, inner member (211) and outer member (212) are in threaded connection and can be connected by rotating inner member (211) relative to outer member (212) to engage threads (240) and (244).

FIG. 17 further details teeth (227) located on the external periphery of rim (225) that define a ratchet and which serve to prevent rotation of inner member (211) relative to outer member (212) so as to maintain cap (210) in a closed state prior to purchase and use. The function of teeth (227) and the way the ratchet defined by same will be described in further detail with reference to FIGS. 25 to 28 in which inner member (211) and outer member (212) of cap (210) are shown in an engaged state.

Figure 18:
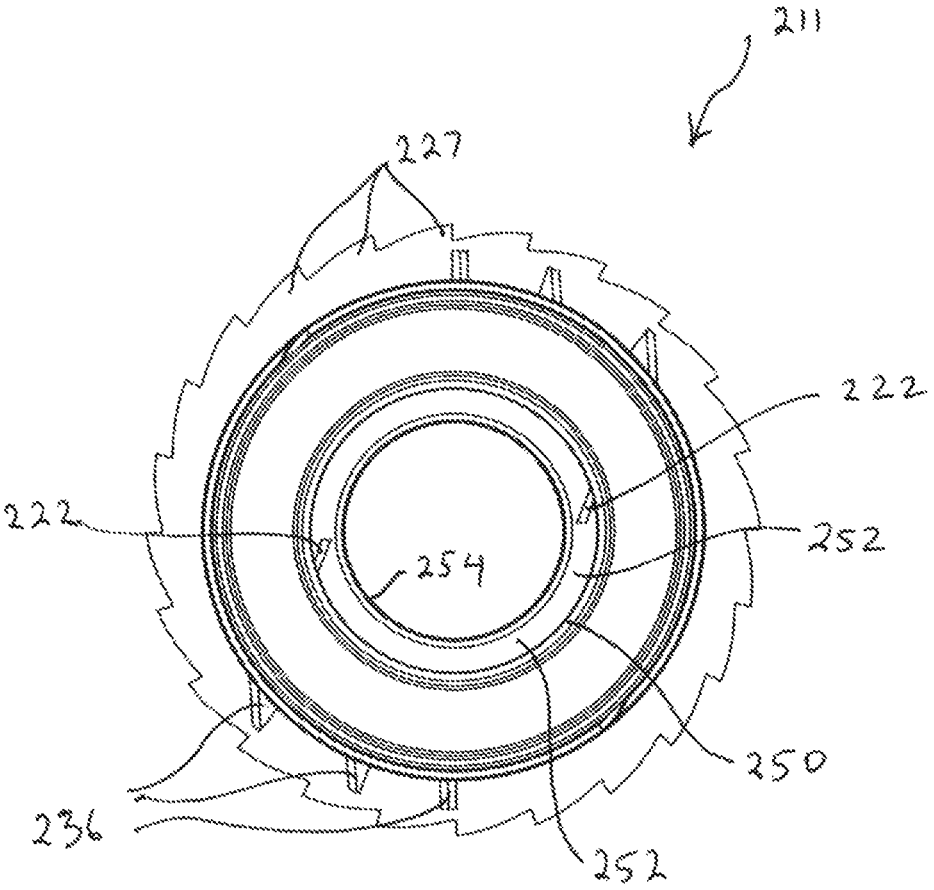
FIG. 18 illustrates a top view of the inner member of the cap shown in FIG. 16.

Inner member (211) is shown in top view in FIG. 18 which details teeth (227) located on the external surface of rim (225) (see FIG. 17) and also guide lugs (236) which engage corresponding drive lugs (134) located on outer member (212). The purpose, function and the way in which guide lugs (236) engage drive lugs (234) will be described in further detail with reference to FIGS. 25 to 28 in which inner (211) and outer (212) members are shown in an engaged state.

FIG. 18 also details flexible tongues (222) that engage projection (223—shown in FIG. 8) located on outer member (212) and that serves to stop the removal of outer member (212) from inner member (211) as will be further described with reference to FIGS. 25 to 28.

FIG. 18 also details base portion (252) that extends radially inwardly a sufficient distance such that inner periphery (254) of base portion (252) forms part of a first seal between inner (211) and outer (212) members when outer member (212) is in a first (closed) position. The function of base portion (252) and how it functions as part of a first seal will be described in further detail with reference to FIG. 27.

FIG. 18 also details guide lugs (236) the function of which will be described in further detail with reference to FIGS. 25 to 28 in which the inner member (211) and outer member (212) of cap (210) are shown in an engaged state.

Figure 19:
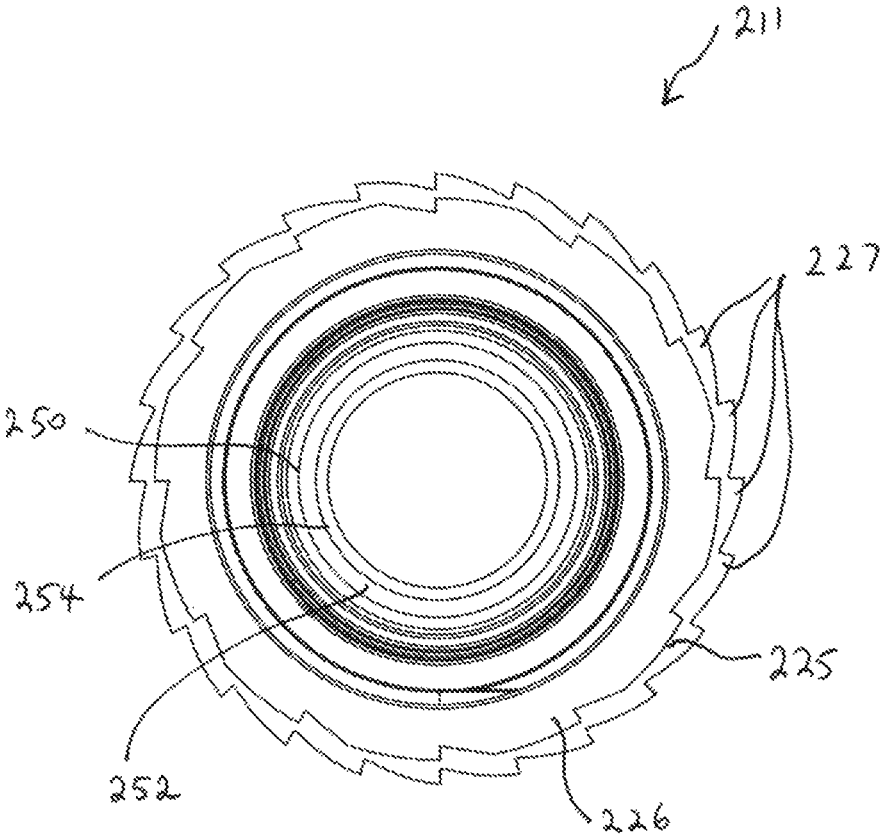
FIG. 19 illustrates a bottom view of the inner member of the cap shown in FIG. 16.

FIG. 19 shows a bottom view of inner member (211) in which teeth (227) are visible. FIG. 19 also details teeth (226) located on the internal surface of rim (225) that serve as another ratchet that prevents the removal of inner member from container (200) during use. The function of teeth (226) and the ratchet defined by same will be described in further detail with reference to FIGS. 25 to 28 that show inner (211) and outer (212) members in an engaged state.

FIG. 19 also shows internal annulus (250) that includes base portion (252) that extends radially inwardly a sufficient distance such that inner periphery (254) forms part of a first seal when it abuts the outer periphery (see FIG. 28) of base portion (232) located on outer member (212) when outer member (212) is in a first (closed) position.

Figure 20:
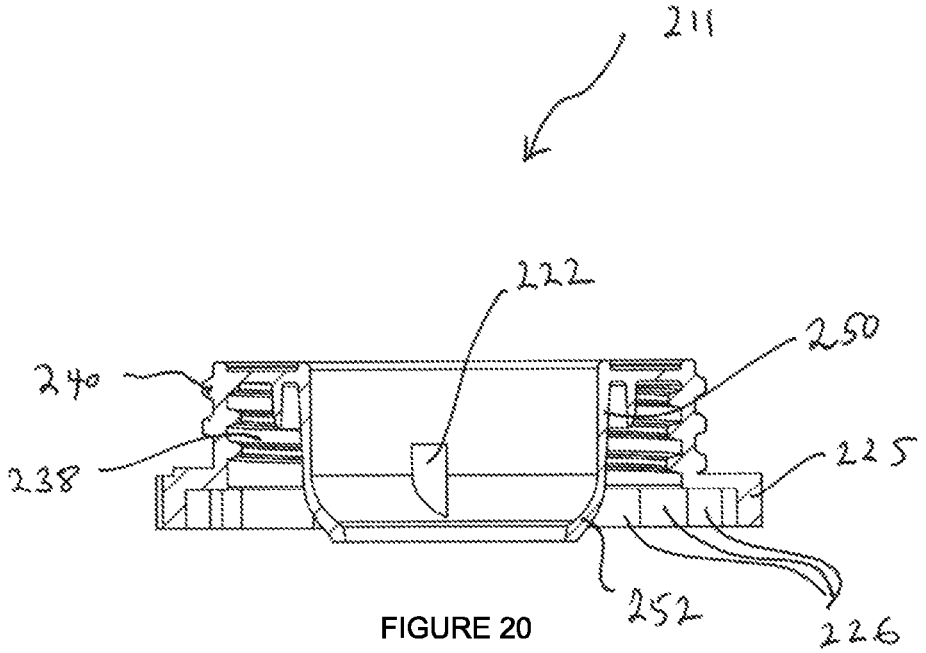
FIG. 20 illustrates a sectional view of the inner member of the cap shown in FIG. 16.

A side sectional view of inner member (211) is shown in FIG. 20 in which teeth (226) are shown. FIG. 20 also details thread (238) located on the internal surface of rim (225) that engages a corresponding thread (not shown) located on container (200) to thereby secure inner member (211) to container (200). FIG. 20 also details thread (240) located on the external surface of rim (225) that serves to connect inner member (211) to outer member (212). FIG. 20 also details flexible tongue (222) used to prevent outer member (212) from being removed from inner member (211).

FIG. 20 also details internal annulus (250) which includes base portion (252) that forms part of a first seal when the inner periphery (254) of base portion (252) abuts the outer periphery (233—see FIG. 24) of base portion (232—see FIG. 24) of outer member (212) when outer member (212) is in a first (closed) position.

The features of outer member (212) will now be described with reference to FIGS. 21 to 24.

Figure 21:
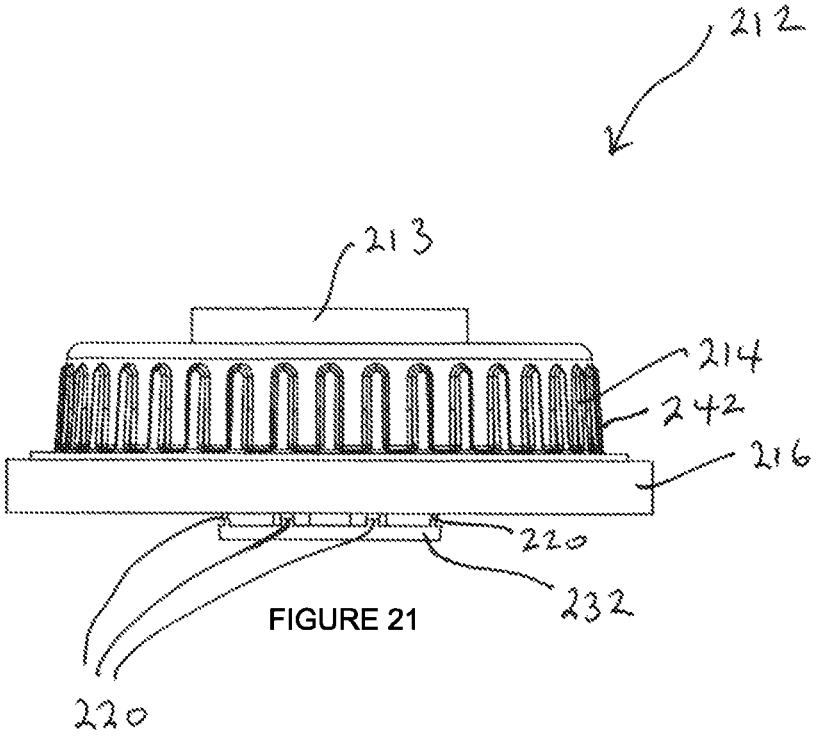
FIG. 21 illustrates a side view of the outer member of the cap shown in FIG. 16.

FIG. 21 shows a side view of outer member (212) detailing lip (213) that serves to prevent, or at least minimise, dripping of liquid during dispensing. FIG. 21 also details knurling (214) located on the external surface of rim (242). As previously described, knurling (214) serves to provide manual grip of outer member (212) when it is moved (rotated) relative to inner member (211) in order to open the cap and allow dispensing of fluid. Knurling (214) also serves to provide mechanical grip when outer member (212) is engaged with inner member (211) and the assembled cap is driven onto container (200) by the use of a conventional capping chuck.

A top view of outer cap (212) is shown in FIG. 21 that details knurling (214) located on rim (242). Ribs (220) are also detailed which define flow channels (221) through which liquid exits and/or air enters container (200) during dispensing. The function of ribs (220) and flow channels (221) is further described with reference to FIGS. 25 to 28 and also FIGS. 29 to 30.

Figure 22:
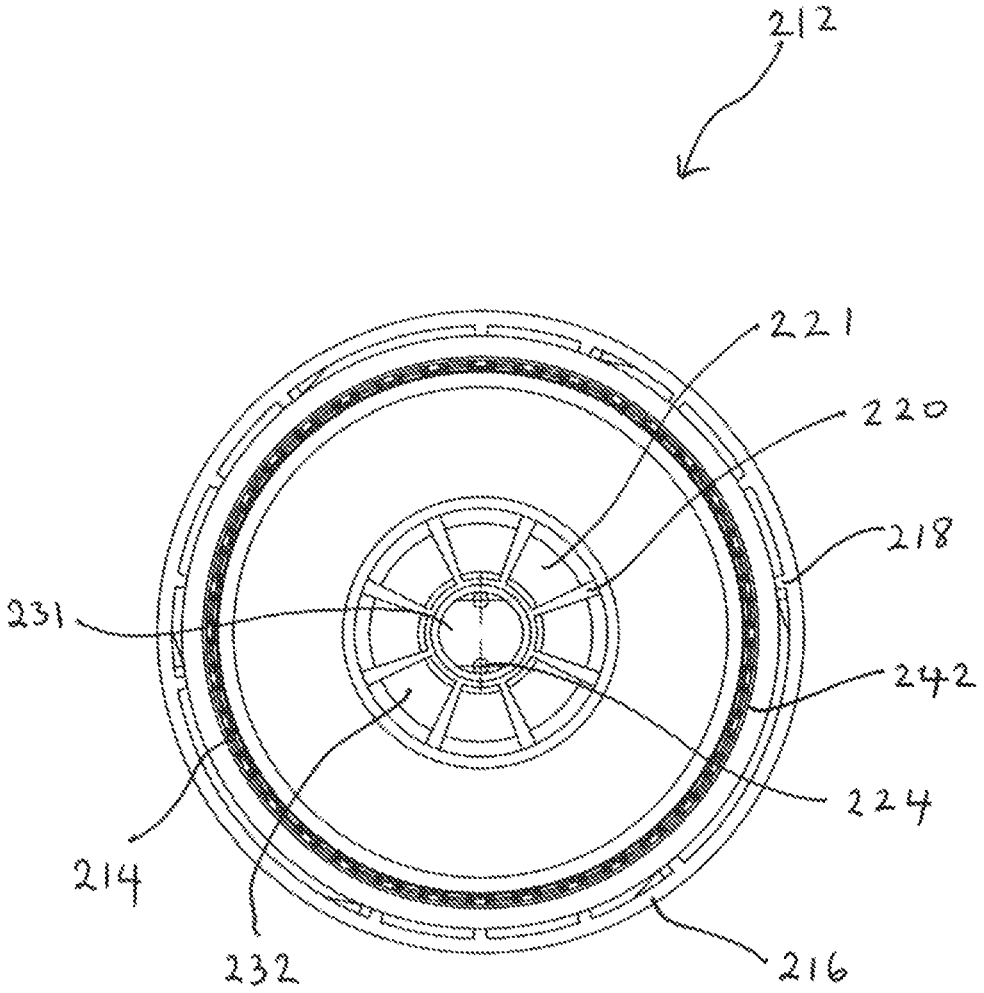
FIG. 22 illustrates a top view of the outer member of the cap shown in FIG. 16.

FIG. 22 also details top portion (231) and base portion (232) of central support structure (230—shown in FIG. 24). Central support structure (230) serves to support ribs (220) and also functions as part of a first seal that substantially prevents the flow of liquid when outer member (212) is in a first (closed) position. Central support structure also includes wall (237—shown in FIG. 24) that forms part of a second seal and that will be described in further detail with reference to FIG. 28.

FIG. 22 also details vent holes (224) which is an optional feature that is adopted when liquids that require continuous venting are stored in container (200). The function of vent hole (224) is further described with reference to FIG. 26 that shows a top view of cap (210) when in an assembled state in which inner member (211) is connected, by threaded connection, to outer member (212).

FIG. 22 further details bridges (218) that connect tamper ring (216) to rim (242) of outer member (212).

Figure 23:
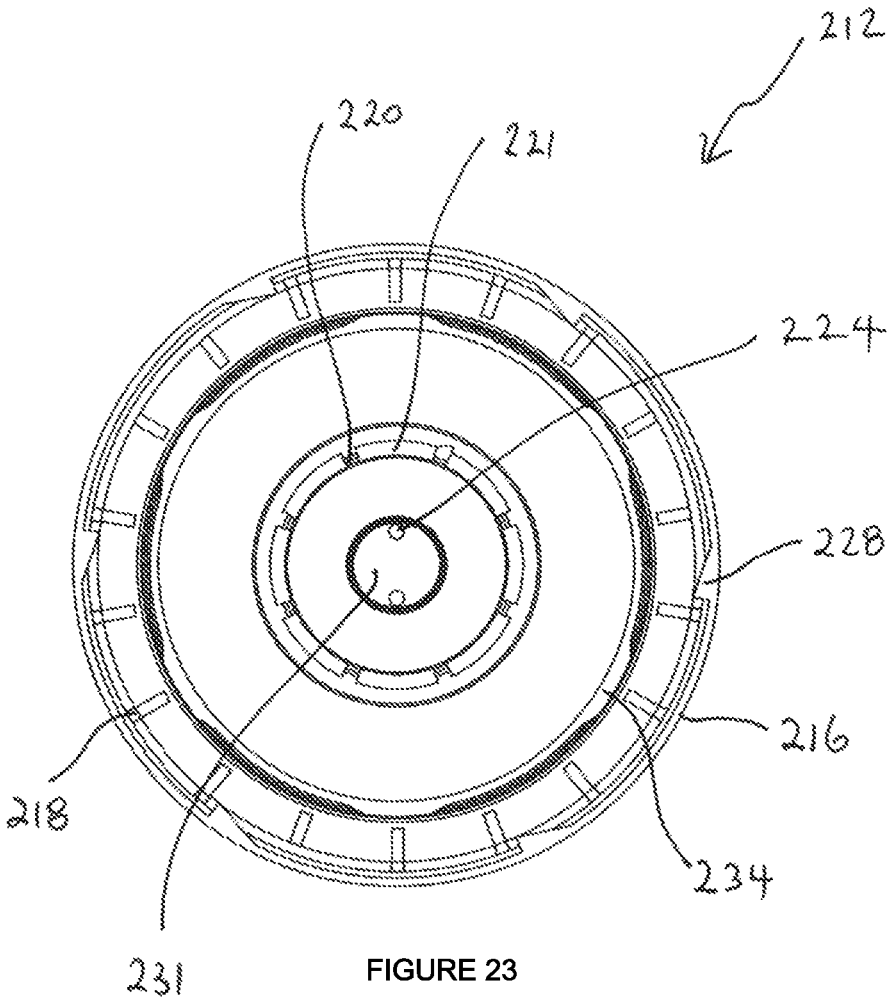
FIG. 23 illustrates a bottom view of the outer member of the cap shown in FIG. 16.

FIG. 23 shows outer member (212) in bottom view detailing teeth (228) that define a ratchet located on the internal surface of tamper ring (216). Also detailed are ribs (220) that that define flow channels (221). Vent hole (224) is also shown that is located on top portion (231) of central support structure (230—shown in FIG. 24). Also shown is top portion (232) located on central support structure (230—shown in FIG. 24).

FIG. 23 also details drive lugs (234) the function of which are described in detail with reference to FIGS. 25 to 28 that show cap (210) in an assembled state in which inner member (211) is connected, by threaded connection, to outer member (212).

A side sectional view of outer member (212) is shown in FIG. 24 in which lip (213) and ribs (220) are shown. Ribs (220) are connected to central support structure (230) which includes a top portion (231) and also a base portion (232). Base portion (232) serves to form part of a first seal and thereby substantially prevents the flow of liquid when outer member (212) is in a first (closed) position. The function of the first seal is further described with reference to FIGS. 25 to 28 which detail cap (210) when in an assembled state in which inner member (211) is connected, by threaded connection, to outer member (212).

Also detailed in FIG. 24 is thread (244) located on an internal surface of rim (242) of outer member (212) that serves to connect, via threaded connection, inner (211) and outer (212) members.

Figure 25:
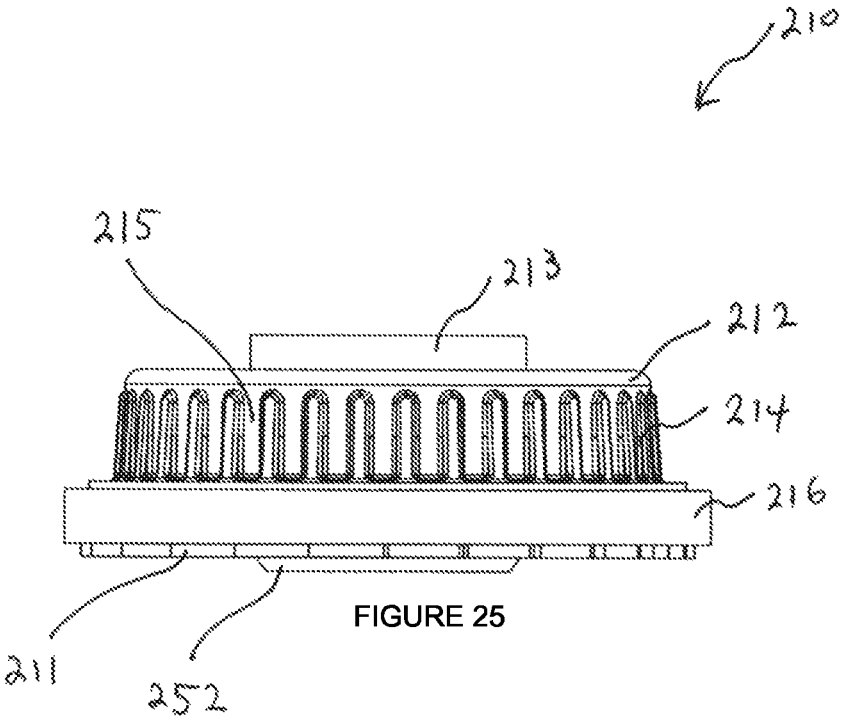
FIG. 25 illustrates a top view of the cap shown in FIG. 16 in which the inner and outer members of the cap are in an engaged state.
Figure 26:
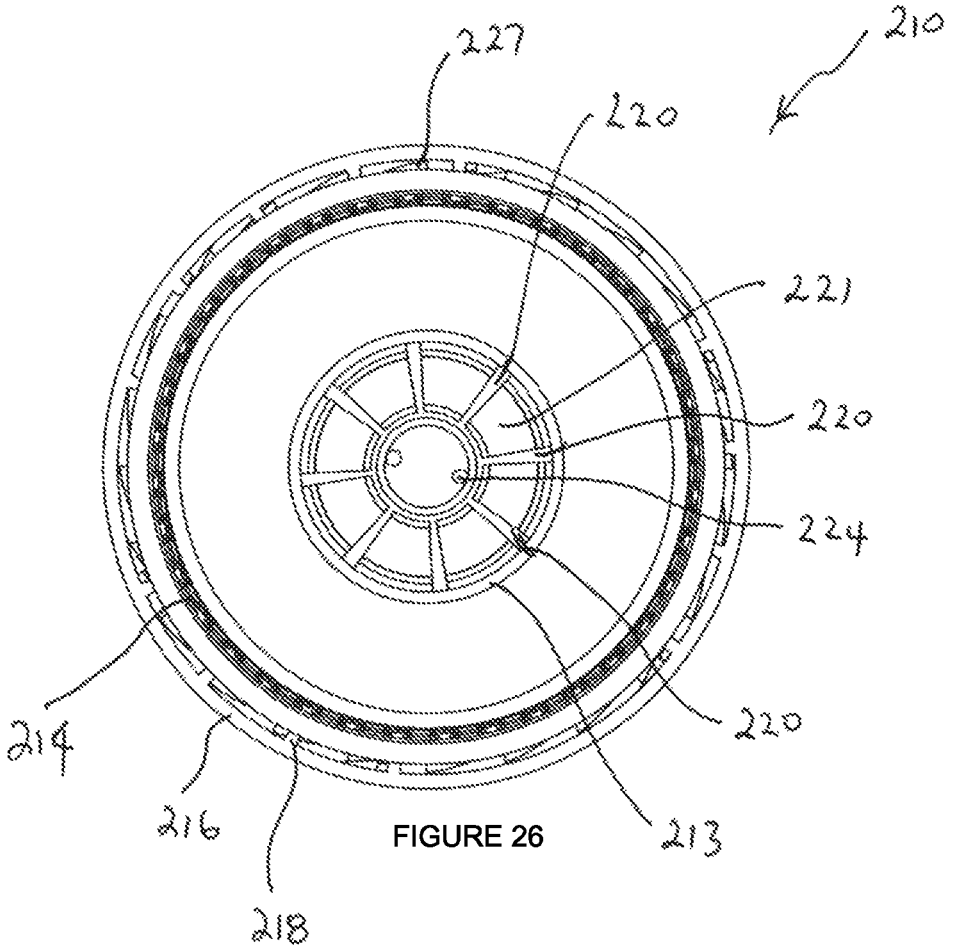
FIG. 26 illustrates a bottom view of the cap shown in FIG. 16 in which the inner and outer members of the cap are in an engaged state.
Figure 27:
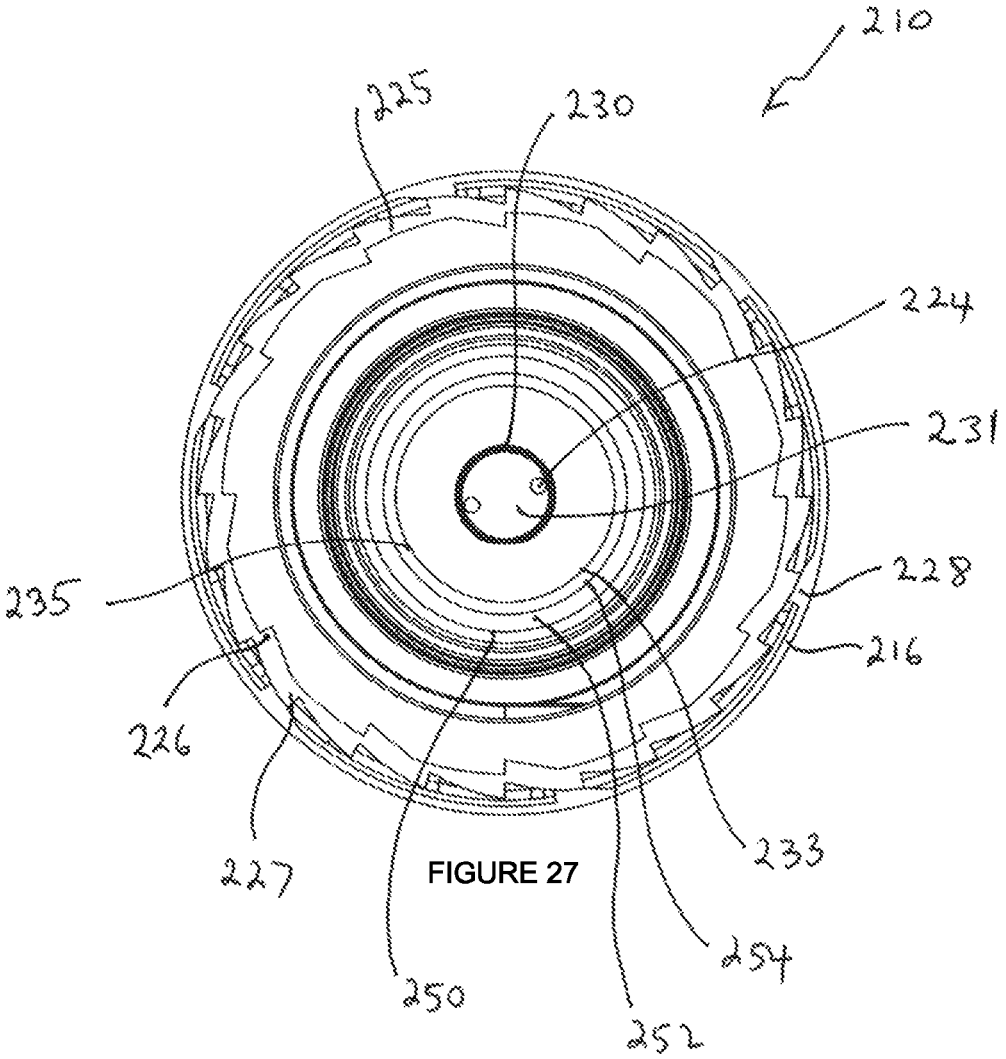
FIG. 27 illustrates a sectional view of the cap shown in FIG. 16 in which the inner and outer members of the cap are in an engaged state.
Figure 28:
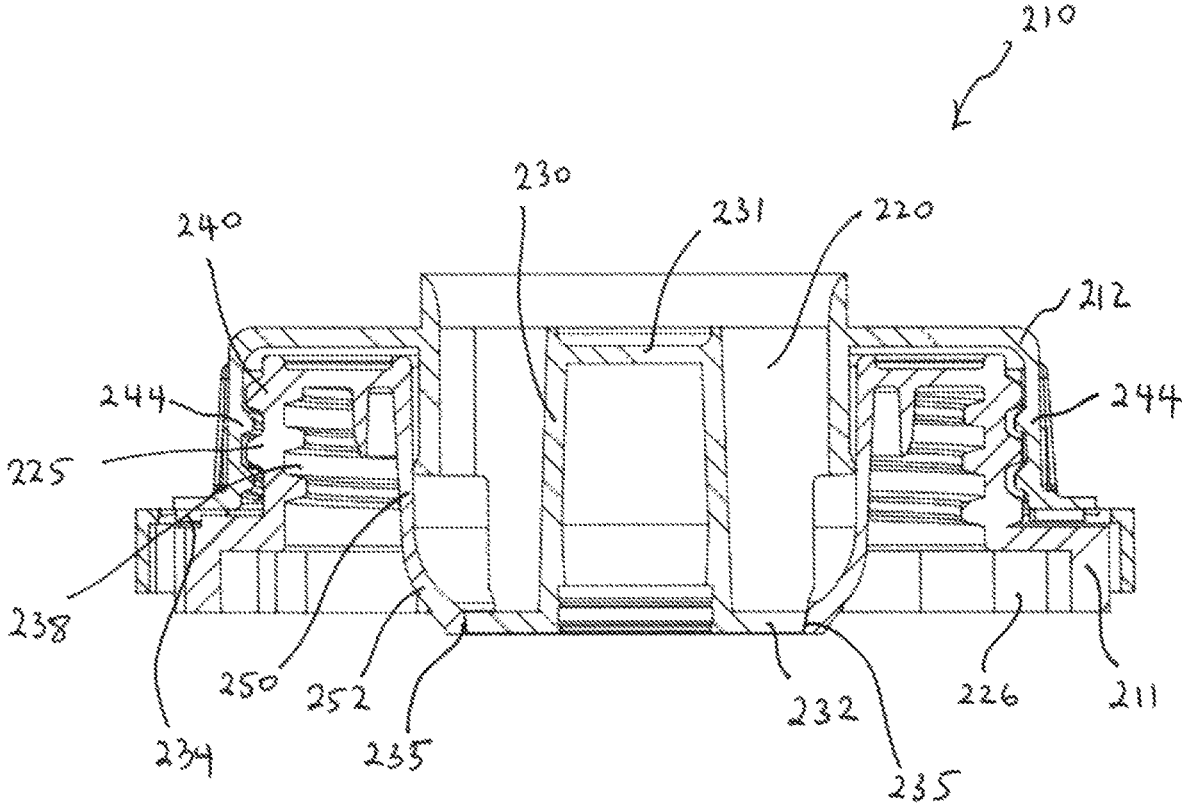
FIG. 28 illustrates a sectional view of the outer member of the cap shown in FIG. 16.

The relationship between inner member (211) and outer member (212) when the cap is in an engaged state is shown in FIGS. 25 to 28 and, in particular, the sectional view shown in FIG. 28. With reference to FIG. 25, cap (210) is shown in side view detailing outer member (212) that includes lip (113) that prevents, or at least minimises, any excess dripping of the liquid contents during dispensing. Outer member (212) also details knurling (214) surrounding the external surface of rim (215) of outer member (212).

FIG. 25 also shows tamper ring (216) connected to outer member (212) by a series of bridges (118—visible in FIG. 26) that may be broken by the manual application of a force when the cap is used and opened for the first time. Upon breakage of bridges (218), outer member (212) is able to be moved (rotated) relative to inner member (211) from a first (closed) position to a second (open) position to thereby open cap (210) and enable fluid contained within container (200) (shown in FIG. 16) fitted with cap (210) to be dispensed from container (200).

Cap (210) is shown in top view in FIG. 26, detailing, once again, lip (213) and knurling (214) located on outer member (212). Outer member (212) also includes ribs (220) disposed in a spoke arrangement and which define a plurality of flow channels (221) through which liquid passes during dispensing of the liquid from container (200) shown in FIG. 16.

Outer member (212) further includes, in this embodiment, optional vent holes (224) that are useful when liquids that require continuous venting are stored within container (200).

Referring now to FIG. 27, a bottom view of cap (210) is shown that details vent hole (224) located on outer member (212). FIG. 14 also details tamper ring (216) connected to outer member (212) of which only the top portion (231) of the central support structure (230—see FIG. 24) of outer member (212) is visible.

FIG. 27 also details dual ratchet systems adopted with cap (210) that each serve to secure inner member (211) to container (200) and also avoids a user tampering with the contents of container (200) prior to purchase and/or use. In this regard, it will be appreciated that a ratchet broadly defines any mechanical device that allows continuous rotary motion of a part only in one direction whilst preventing motion of the part in the opposite direction.

The first ratchet system includes a plurality of teeth (226) located on an internal surface of the periphery of rim (225) of inner member (211), wherein the plurality of teeth (226) engage one or more pawls located on the neck of container (200) (not shown). The one or more pawls located on the neck of container (200) prevent rotation of inner member (211) in a direction that would disengage inner member (211) from container (200). That is, teeth (226) located on inner member (211) and pawls (not shown) located on the neck of container (200) permit rotation of inner member only in one direction to thereby engage and secure inner member (211) to container (200) during installation of cap (210). Accordingly, once inner member (211) and/or cap (210) is installed on container (200), removal of inner member (211) and/or cap (210) is not possible unless excessive force is applied which would likely damage inner member (211) and/or container (200).

The second ratchet system includes a plurality of teeth (227) located on an external surface of the periphery of rim (225) of inner member (211) wherein plurality of teeth (227) engage one or more teeth (228) located on an internal surface of tamper ring (216). Accordingly, whilst bridges (218—shown in FIG. 26) remain intact, rotation of outer member (212) relative to inner member (211) is restricted thereby preventing movement of outer member (212) from an first (closed) position to a second (open position). Upon breakage of bridges (218) by the manual application of a force when the cap is used and opened for the first, outer member (212) is then able to be moved (rotated) relative to inner member (211) from a first (closed) position to a second (open) position to thereby open cap (210) and enable liquid contained within container (200) to be dispensed from container (200) through a dispensing opening of cap (210).

FIG. 27 also shows internal annulus (250) within internal member (211) having base portion (252) that extends radially inwardly a sufficient distance such that inner periphery (254) of base portion (252) forms part of a first seal and abuts outer periphery (233) of base portion (232 of support structure 230—shown in FIG. 28) when outer member (212) is in a first (closed) position.

FIG. 28 is a sectional view of cap (210) showing inner member (211) and outer member (212) in an engaged state. FIG. 28 details teeth (226) located on an internal surface of the periphery of rim (225) that form part of a first ratchet system as previously described. FIG. 28 also details thread (238) located on an internal surface of rim (225) of inner member (211) that serves to engage, by threaded connection, inner member (211) to the neck of container (200) (not shown). FIG. 28 further details thread (240) located on an external surface of rim (225) of inner member (211) that serves to engage inner member (211) to outer member (212) by threaded connection to thread (244) located on an internal surface of rim (242) of outer member (212).

FIG. 28 also details ribs (220) that, as previously discussed, serve to avoid or at least ameliorate the "glugging" of liquid as it exits container (200) during dispensing, and which also serve to permit air flow back into container (200) during dispensing thereby permitting and/or promoting liquid flow without having to puncture container (200).

In an embodiment, cap (210) is installed on container (200) whilst assembled, that is, when the inner (211) and outer (212) members are in an engaged state, using an automatic capping machine. Such machines allow for continuous capping of containers using one or multiple chuck heads and are ideal for use in facilities with high volume production.

In order to install cap (210) on container (200), the chuck of a conventional capping machine (not shown) grips outer member (212) of cap (210) and positions same over the neck (not shown) of container (210). Whilst not shown in any one of FIGS. 16 to 28, it will be appreciated the opening of container (200) includes a neck portion on which a thread is located on the external surface that is able to engage thread (238) located on the internal surface of rim (225) of inner member (211). In order to engage and secure cap (210) on container (200), capping chuck rotates cap (210) in a direction that serves to engage thread (238) of inner member (211) with the thread located on the neck of container (200).

In order to avoid binding (seizing) and/or damage of the threads of inner (211) and outer (212) members of cap (210), drive lugs (234) located on outer member (212) (see also FIG. 23) engage and interlock guide lugs (236) (shown in FIG. 18) located on inner member (211) which drive inner member (211) and engage same with the thread located on the neck of container (200) without applying excess pressure on the threads connecting inner and outer members. It will be appreciated that avoiding applying excess pressure on the thread mechanism between inner (211) and outer (212) members serves to avoid, or at least minimises, the risk of damage to the threaded connection and thereby minimises the risk of any leakage of liquid contents during storage, transport or dispensing of the container liquid content. Once again, this is beneficial from an occupational health and safety perspective, particularly in circumstances in which hazardous liquids are stored within, and are dispensed from, container (200).

It will also be appreciated that the engagement of drive lugs (234) and guide lugs (236) also assists in minimising the force required to be applied by a user in order to loosen outer member (112) from inner member (111) to thereby open container (200) in order to dispense liquid contained therein.

FIG. 28 also shows first seal (235—see also FIG. 27) formed between outer periphery (233) of base portion (232) of outer member (212) and inner periphery (254) of base portion (252) of inner member (211). It will be understood that first seal (235) serves to substantially prevent the flow and exit of liquid out of container (200) through dispensing opening of cap (210) when outer member (212) is in a first (closed) position.

FIG. 28 further shows second seal (239) formed between wall (237) that abuts the wall of internal annulus (250) wherein second seal (239) substantially diverts liquid to flow through channels (121) and away from the cavity defined between inner (211) and outer (212) members that house the thread mechanism.

Figure 29:
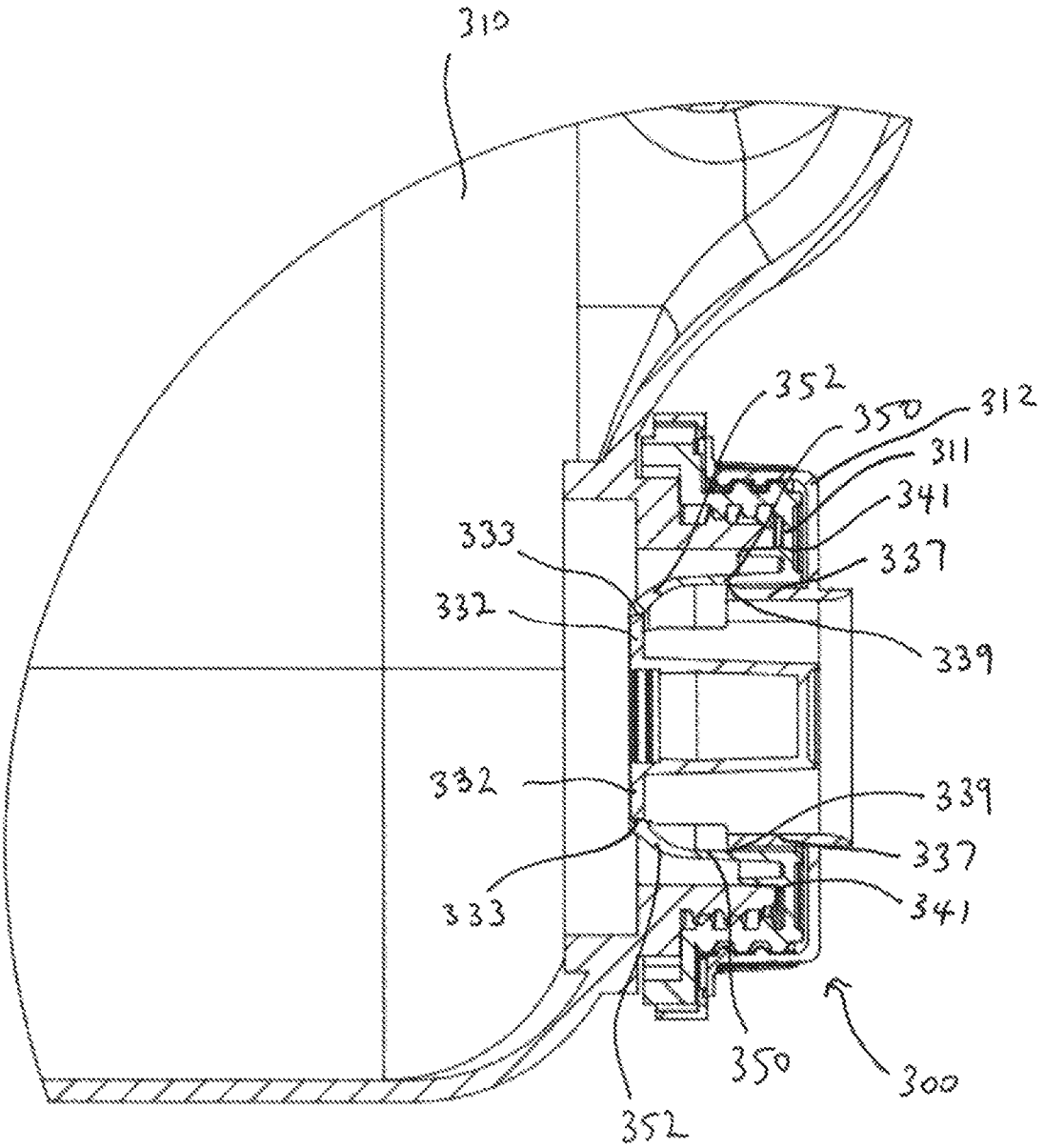
FIG. 29 illustrates a sectional view of a container fitted with a cap in accordance with an embodiment of the present invention, which details first and second seals of the cap when the cap is in a closed state.
Figure 30:
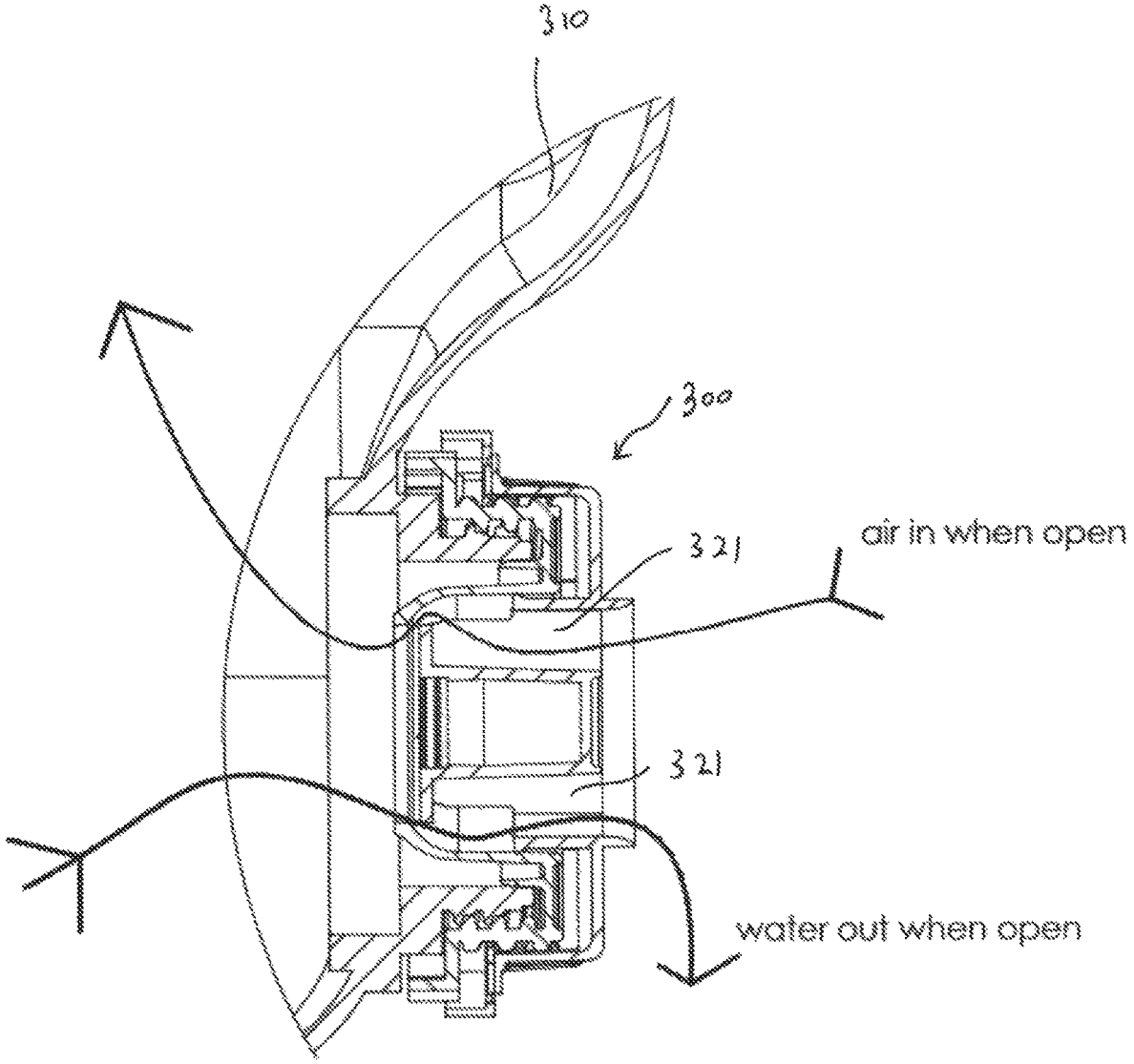
FIG. 30 illustrates a sectional view of the cap and container assembly shown in FIG. 29, which details the fluid (liquid and air) flows through the cap when the cap is an open state and liquid is dispensed from the container.

Referring to FIGS. 29 and 30, cap (300) according to an embodiment of the invention is shown when fitted to a bottle (310) wherein cap (300) is shown in a closed position (FIG. 29) and also in an open position (FIG. 30).

FIG. 29 details first (333), second (339) and third seals. First seal (333) is formed between base portion (332) of central support structure (330) located on outer member (312) that abuts inner periphery (354) of base portion (352) located on inner member (311) when outer member (312) is in a first (closed) position as shown in FIG. 29. Accordingly, liquid flow out of container (310) is substantially prevented when cap (300) is in a closed state and first seal is active.

Second seal (339) is formed between wall (337) that abuts the wall of internal annulus (350) to form second seal (339) that substantially diverts liquid to flow through channels (321—see FIG. 30) and away from the cavity defined between inner (311) and outer (312) members that house the thread mechanism when cap (300) is in an open state.

The threaded connection between inner member (311) and outer member (312) enables cap (300) to be moved from a first (closed) position (as shown in FIG. 29) to a second (open) position (as shown in FIG. 30) to thereby define flow channel (321) through which liquid can flow and exit container (310) when in a sufficiently tilted state.

In addition, the threaded connection between inner member (311) and outer member (312) enables outer member (312) to be loosened from inner member (311) wherein the rate of liquid flow exiting container (310) is based upon the extent to which outer member (312) is loosened from inner member (311).

FIG. 29 also details third seal (341) that substantially prevents liquid flow within the cavity defined between container (300) and the inner wall of inner member (311) when the cap (300) is in sealing engagement with container (310).

Figure 31:
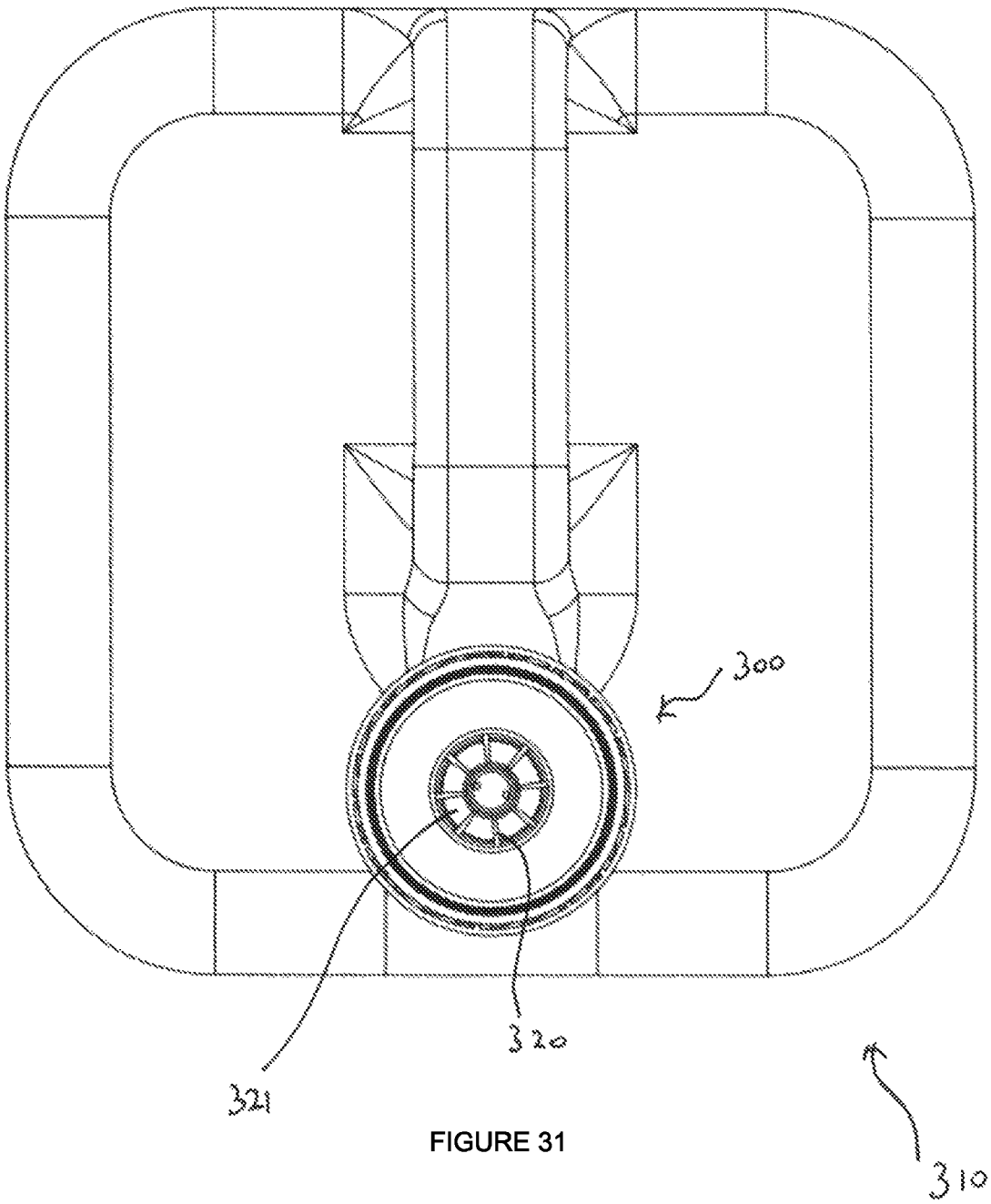
FIG. 31 illustrates a top view of the container and cap assembly shown in FIG. 29, which details the channels through which air flows into the container and liquid flows out of the container during dispensing.

As can be seen from FIGS. 30 and 31, liquid flows out from at least one flow channels (321) whilst air is simultaneously encouraged to flow into container (300) through at least one flow channel (321) to thereby mitigate "glugging" as liquid exits container (300). Without seeking to be bound by theory, is it thought that the spoked ribbed arrangement that defines the plurality of flow channels (321) encourages air to flow in at least one or more channels (321) and thereby enter container (300) during dispensing of liquid which mitigates the "glugging" effect. It is also thought that even when liquid flows through all flow channels (321) such that substantially no air enters container (300) through flow channels (321) during dispensing of its liquid contents, the "glugging" effect is still mitigated by the presence of ribs (320) that serve to retard the liquid flow as it exits container (300) through one or more channels (321).

As can be seen from the sectional views of two different embodiments of the cap shown in FIGS. 15 and 28 (see also FIGS. 29 and 30), the central support structure of the outer member that defines the ribs (320) and fluid flow channels (321), and also the internal annulus of the inner member are configured such that these portions substantially extend (or are recessed) within the container when the cap is fitted over the container opening. This arrangement assists in avoiding, or at least minimises, any parts jutting out from the container which strengthens the arrangement and minimises the risk of breakage or damage of any parts. This arrangement also permits and/or facilitates storage and/or stacking of the containers during transport and storage.

Figure 32:
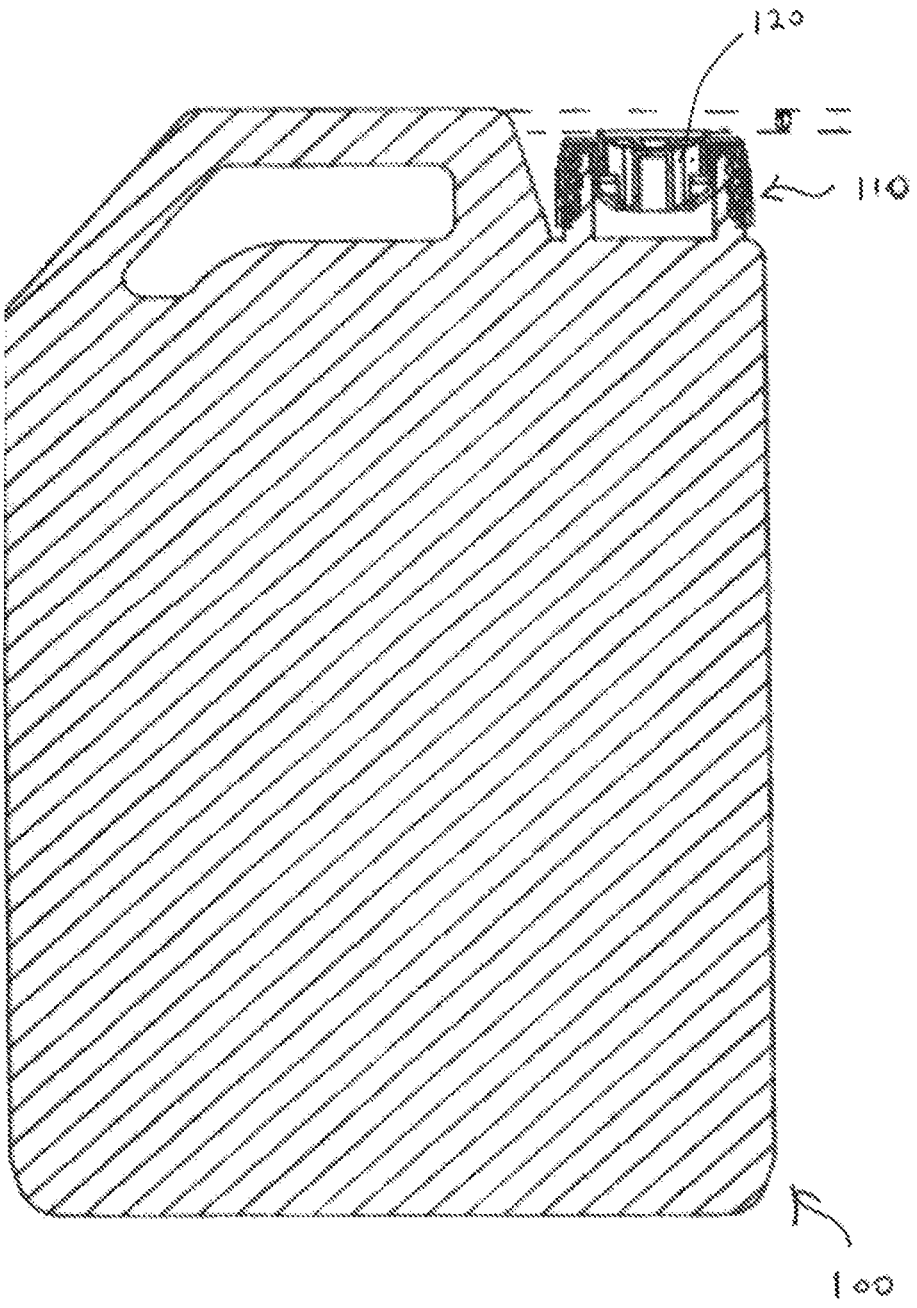
FIG. 32 illustrates the container and cap assembly of FIG. 1 in side sectional view.
Figure 33:
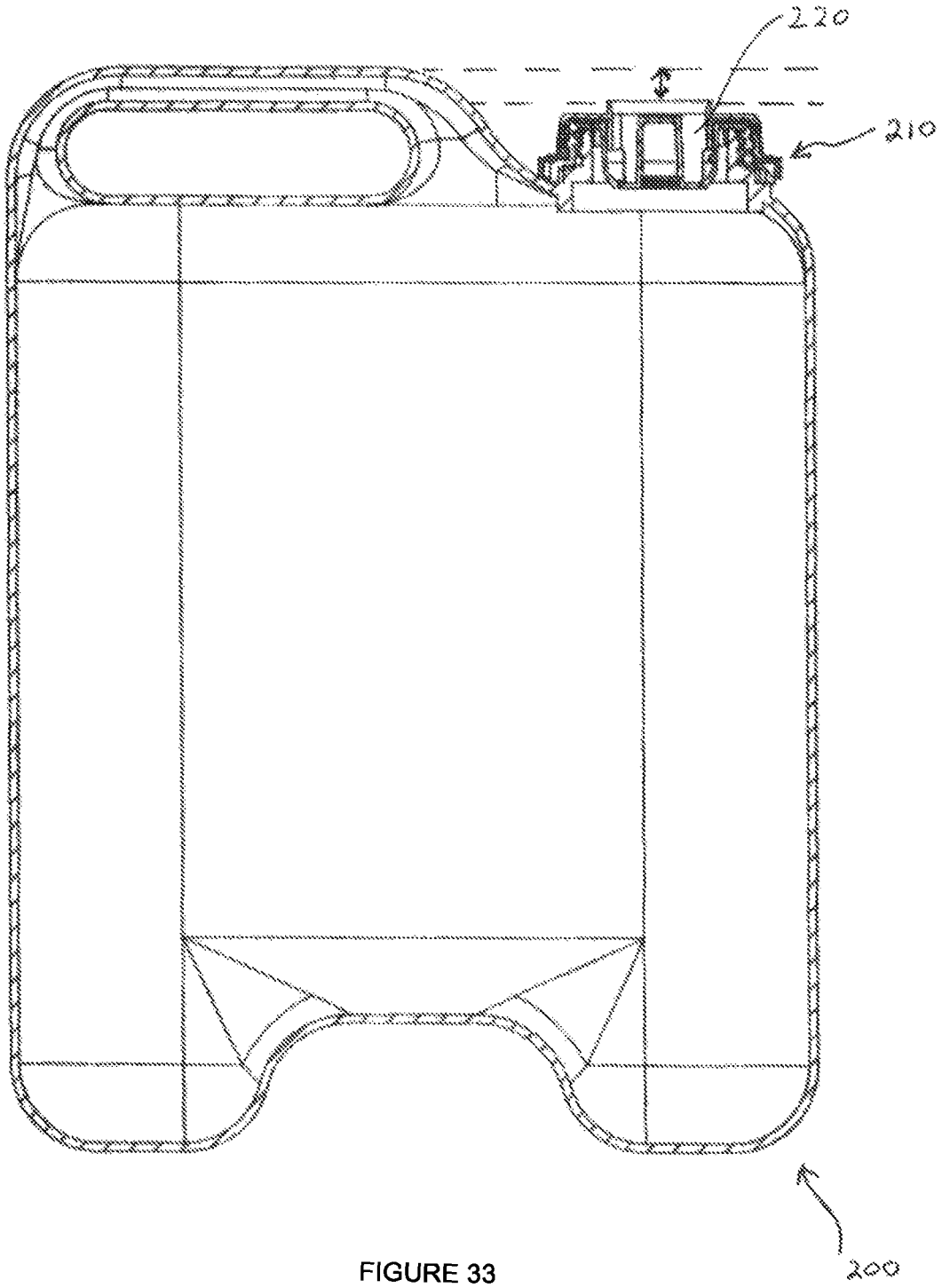
FIG. 33 illustrates the container and cap assembly of FIG. 16 in side sectional view

FIGS. 32 and 33 show the container/cap assemblies of FIGS. 1 and 16, respectively, shown in side sectional view in which the cap is in sealing engagement with the container. As can be clearly seen from the embodiments shown in FIGS. 32 and 33, since the flow passage defined by ribs (120, 220) extends substantially into the container when the cap housing is in sealing engagement with the container, the plurality of channels (121, 221) within the cap flow passage do not project substantially beyond the outer perimeter of the container, thereby allowing/enabling stacking of the containers during, for example, storage and/or transport.

It will be appreciated that the cap in accordance with the invention may be manufactured from a variety of materials and by any conventional method. For example, any suitable polymer material may be adopted including, but not limited to, polypropylene (PP), low density polyethylene (LDPE) or high density polyethylene (HDPE).

The caps may also be made using any suitable manufacturing process including, but not limited to, 3D (additive) printing technology or injection moulding.

In an embodiment, the caps are injection moulded using polypropylene (PP).

Accordingly, the cap and container/cap assembly of the present invention assists in promoting controlled flow and avoids, or at least ameliorates, splashing/spillage of fluids during dispensing. The cap and container/cap assembly of the present invention also avoids the need to puncture the container in order to promote flow of the dispensing fluid.

In an embodiment, the cap is substantially circular in shape such that any conventional capping chuck to able to be adopted during manufacture and assembly of the sealed (capped) container. In addition, the circular shape avoids any components or sections jutting out from the cap which could be damaged and/or broken during transport or storage of the cap and container assembly.

The cap may be supplied with the inner and outer members in an engaged state wherein the assembled cap is also located on a container. Alternatively, the cap may be supplied separately in which the inner and outer members are in engaged state such that the assembled cap only needs to be applied to any container of choice.

In embodiments, the cap may be manufactured in a variety of sizes and configured to fit, by threaded engagement, containers/bottles of a variety of shapes and sizes.

The cap and container/cap assembly of the present invention further avoids the need to adopt additional parts for connection to the container in order to promote and/or achieve a more controlled flow of fluid from the container during dispensing. Avoiding the need for additional parts reduces the risk of loss of any such parts thereby ensuring that a container is able to adequately re-sealed in the event only a portion of its contents are dispensed at any given time. All these factors contribute that a cap and container/cap assembly that is more convenient to use and reduces the risk of any occupational health and safety hazards.

Throughout this specification and the claims which follow, unless the context requires otherwise, the word "comprise", and variations such as "comprises" and "comprising", will be understood to mean the inclusion of a stated integer or step, or group of integers or steps, but not the exclusion of any other integer or step, or group of integers or steps.

The reference to any prior art in this specification is not, and should not be taken as an acknowledgement, or any suggestion that, the prior art forms part of the common general knowledge.

The claims defining the invention are as follows:

1. A cap for a container including a dispensing opening operable to be selectively sealed and a housing configured for sealing engagement with a container opening, said housing including an outer member and an inner member, the inner member configured to engage the container opening and the outer member configured to engage the inner member, said outer member defining a passage along a longitudinal axis thereof, the passage having a plurality of ribs disposed in the passage and extending radially from a location proximal to an outer periphery of the outer member towards a central support structure that extends along said longitudinal axis to thereby define a spoked arrangement and a plurality of enclosed flow channels, each enclosed flow channel defined by a surface of two ribs of the plurality of ribs, the central support structure and an internal surface of the outer member which, when the container is in a sufficiently tilted state, cause liquid in the container to be in contact with the surface of the ribs as the liquid flows through one or more of the plurality of enclosed flow channels and as the liquid exits through the dispensing opening, wherein at least one flow channel is a liquid-flow channel through which the liquid flows out of the dispensing opening when unsealed.

2. A cap according to claim 1, wherein the passage extends into the container when the cap housing is in sealing engagement with the container opening.

3. A cap according to claim 1, wherein the inner member and the outer member are engaged by a threaded connection.

4. A cap according to claim 1, wherein the outer member is moveable between a first position in which the outer member is tightened on the inner member and a first seal is operable between the outer member and the inner member to prevent the flow of the liquid out from the dispensing opening, and a second position in which the outer member is loosened from the inner member and wherein the first seal is inoperable such that the liquid is not prevented from flowing out from the dispensing opening.

5. A cap according to claim 4, wherein a flow rate of the liquid through the dispensing opening is based upon an extent to which the outer member is loosened from the inner member.

6. A cap according to claim 5, wherein the housing is configured to prevent the outer member from being removed from the inner member.

7. A cap according to claim 4, wherein said central support structure including a base portion that extends radially outwardly a sufficient distance such that an outer periphery of the support structure base portion is disposed in a path of the liquid and/or air flow through the plurality of channels and forms part of the first seal.

8. A cap according to claim 7, wherein the inner member includes an internal annulus that at least partially defines said passage, the internal annulus including a base portion that extends radially inwardly a sufficient distance such that an inner periphery of the internal annulus base portion forms part of said first seal and is caused to abut with the outer periphery of the support structure base portion when the outer member is in said first position.

9. A method of dispensing liquid from a container, the method including tilting the container to cause the liquid to exit through a dispensing opening of a cap operable for sealing engagement with an opening of the container, the cap including:

an opening operable to be selectively sealed; and a housing including an outer member and an inner member, the inner member configured to engage the container opening and the outer member configured to engage the inner member, said outer member defining a passage along a longitudinal axis thereof, the passage having a plurality of ribs disposed in the passage and extending radially from a location proximal to an outer periphery of the outer member towards a central support structure that extends along said longitudinal axis to thereby define a spoked arrangement and a plurality of enclosed flow channels, each enclosed flow channel defined by a surface of two ribs of the plurality of ribs, the central support structure and an internal surface of the outer member which, when the container is in a sufficiently tilted state, cause the liquid in the container to be in contact with the surface of the ribs as the liquid flows through one or more of the plurality of enclosed flow channels and as the liquid exits through the dispensing opening, wherein at least one flow channel is a liquid-flow channel through which the liquid flows out of the dispensing opening when unsealed.

10. A method according to claim 9, wherein the outer member is moved between a first position in which the outer member is tightened on the inner member and a first seal is operable between the outer member and inner member to prevent the flow of the liquid out from the dispensing opening, to a second position in which the outer member is loosened from the inner member and wherein the first seal is inoperable such that the liquid is not prevented from flowing out from the dispensing opening, to thereby dispense the liquid from the container.

11. A method according to claim 9, wherein a flow rate of the liquid through the dispensing opening is controlled based upon the extent to which the outer member is loosened from the inner member.

12. A container assembly including a container and a cap, the cap including a dispensing opening operable to be selectively sealed and a housing configured for sealing engagement with an opening in the container, said housing including an outer member and an inner member, the inner member configured to engage the container opening and the outer member configured to engage the inner member, said outer member defining a passage along a longitudinal axis thereof, the passage having a plurality of ribs disposed in the passage and extending radially from a location proximal to an outer periphery of the outer member towards a central support structure that extends along said longitudinal axis to thereby define a spoked arrangement and a plurality of enclosed flow channels, each enclosed flow channel defined by a surface of two ribs of the plurality of ribs, the central support structure and an internal surface of the outer member which, when the container is in a sufficiently tilted state, cause liquid in the container to be in contact with the surface of the ribs as the liquid flows through one or more of the plurality of enclosed flow channels and as the liquid exits through the dispensing opening, wherein at least one flow channel is a liquid-flow channel through which the liquid flows out of the dispensing opening when unsealed.

13. A method of manufacturing a cap for sealing engagement with a container opening, the method including the steps of:

additively fabricating a housing defining a passage along a longitudinal axis thereof, the housing including:

an external wall enclosing an internal spoke arrangement of a plurality of ribs radially emanating from a central support structure thereby defining a plurality of enclosed flow channels, each enclosed flow channel defined by a surface of two ribs of the plurality of ribs, the central support structure and an internal surface of an outer member, wherein the external wall, spoke arrangement and central support structure together define the outer member of the cap, and an inner member of the cap, wherein the inner member is configured to sealingly engage the container opening by threaded connection and is also configured to sealingly engage the outer member by threaded connection.

* * * * *